US010161342B2

(12) United States Patent
Natori et al.

(10) Patent No.: US 10,161,342 B2
(45) Date of Patent: Dec. 25, 2018

(54) CONTROL DEVICE FOR HIGH-PRESSURE PUMP

(71) Applicant: DENSO CORPORATION, Kariya, Aichi-pref. (JP)

(72) Inventors: Takahisa Natori, Kariya (JP); Tomoyuki Takagawa, Kariya (JP); Hiroshi Yamaguchi, Kariya (JP); Yasuo Hirata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/567,367

(22) PCT Filed: Apr. 4, 2016

(86) PCT No.: PCT/JP2016/001892
§ 371 (c)(1),
(2) Date: Oct. 17, 2017

(87) PCT Pub. No.: WO2016/170744
PCT Pub. Date: Oct. 27, 2016

(65) Prior Publication Data

US 2018/0156152 A1 Jun. 7, 2018

(30) Foreign Application Priority Data

Apr. 24, 2015 (JP) ..... 2015-089882
Oct. 26, 2015 (JP) ..... 2015-210147
(Continued)

(51) Int. Cl.
*F02M 59/36* (2006.01)
*F02D 41/24* (2006.01)
(Continued)

(52) U.S. Cl.
CPC ..... *F02D 41/2464* (2013.01); *F02D 41/3082* (2013.01); *F02D 41/3845* (2013.01);
(Continued)

(58) Field of Classification Search
CPC ..... F02D 41/2464; F02D 2200/021; F02D 2200/023; F02D 2200/0606; F02M 51/04;
(Continued)

(56) References Cited

U.S. PATENT DOCUMENTS 6,546,918 B2 * 4/2003 Onishi ..... F02D 41/1462 123/456
9,726,104 B2 * 8/2017 Tokuo ..... F02D 41/20
(Continued)

FOREIGN PATENT DOCUMENTS

JP 2008-002428 1/2008
JP 2014-005970 1/2014
(Continued)

*Primary Examiner* — Hai Huynh
(74) *Attorney, Agent, or Firm* — Nixon & Vanderhye PC

(57) ABSTRACT

A control device for a high-pressure pump includes: a determination unit, an acquisition unit, and an electric power setting unit. The determination unit determines whether a movable portion of an electromagnetic valve has been moved to a closed position to close the electromagnetic valve when the electromagnetic valve is energized. The acquisition unit acquires, as an electromagnetic-valve response time, a period of time from a start of the energization of the electromagnetic valve until when it is determined that the electromagnetic valve has been closed. The electric power setting unit sets a supply power to the electromagnetic valve by repeating a process in which the supply power to the electromagnetic valve is reduced so as to be smaller than a previous value until the electromagnetic-valve response time reaches a predefined upper limit value.

11 Claims, 20 Drawing Sheets

(30) Foreign Application Priority Data

Nov. 13, 2015 (JP) ..... 2015-222770
Nov. 13, 2015 (JP) ..... 2015-222771

(51) Int. Cl.

| | |
|---|---|
| ***F02M 59/02*** | (2006.01) |
| ***F02M 65/00*** | (2006.01) |
| ***F02M 51/04*** | (2006.01) |
| ***F02D 41/30*** | (2006.01) |
| ***F02D 41/38*** | (2006.01) |

(52) U.S. Cl.
CPC ..... *F02M 51/04* (2013.01); *F02M 59/025* (2013.01); *F02M 59/36* (2013.01); *F02M 65/005* (2013.01); *F02D 2200/021* (2013.01); *F02D 2200/023* (2013.01); *F02D 2200/0606* (2013.01)

(58) Field of Classification Search
CPC .... F02M 59/36; F02M 59/366; F02M 59/025; F02M 65/005
USPC ..... 123/457, 458, 510, 511
See application file for complete search history.

(56) References Cited

U.S. PATENT DOCUMENTS

| | | | |
|---|---|---|---|
| 2010/0237266 | A1 | 9/2010 | Haaf et al. |
| 2013/0085658 | A1 | 4/2013 | Miyake |
| 2016/0186741 | A1 | 6/2016 | Sakamoto et al. |

FOREIGN PATENT DOCUMENTS

| | | | | |
|---|---|---|---|---|
| JP | 2015-066329 | | 4/2015 | |
| WO | WO 2015/015724 | A1 * | 2/2015 | ..... F02M 59/44 |

* cited by examiner (a) WHEN DETERMINATION COUNT IS CONSTANT (b) WHEN DETERMINATION COUNT IS CHANGED

TABLE OF DETERMINATION COUNT

| | | | |
|---|---|---|---|
| ELECTROMAGNETIC VALVE RESPONSE TIME | SHORT | ···· | LONG |
| SUPPLY POWER | LARGE | ···· | SMALL |
| DETERMINATION COUNT | SMALL | ···· | LARGE |

CONTROL DEVICE FOR HIGH-PRESSURE PUMP

CROSS REFERENCE TO RELATED APPLICATION

This application is the U.S. national phase of International Application No. PCT/JP2016/001892 filed Apr. 4, 2016 which designated the U.S. and claims priority to Japanese Patent Application No. 2015-89882 filed on Apr. 24, 2015, Japanese Patent Application No. 2015-210147 filed on Oct. 26, 2015, Japanese Patent Application No. 2015-222770 filed on Nov. 13, 2015, and Japanese Patent Application No. 2015-222771 filed on Nov. 13, 2015, the entire contents of each of which are incorporated herein by reference.

TECHNICAL FIELD

The present disclosure relates to a control device for a high-pressure pump including an electromagnetic valve that moves a quantity control valve of the high-pressure pump to open and close.

BACKGROUND ART

Direct injection engines, which inject fuel into each cylinder directly, atomize the injected fuel using high injection pressure. To do so, such an engine employs an electric low-pressure pump to supply fuel from a fuel tank to a high-pressure pump, which is driven by the power of the engine, so that the high-pressure pump discharges high-pressure fuel to fuel injection valves.

Such a high-pressure pump includes a quantity control valve to open and close the suction port of the high-pressure pump and an electromagnetic valve to move the quantity control valve for the opening and closing. Energization of the electromagnetic valve is controlled to control a period over which the quantity control valve is closed and thereby control the quantity of fuel to be discharged by the high-pressure pump and thus the fuel pressure.

When the electromagnetic valve is being closed, its movable portion strikes its stopper portion, generating a vibration, which may lead to an unpleasant noise. A solution for this is described in Patent Literature 1 (JP 2010-533820 A). A current value to be used when an electromagnetic valve of a high-pressure pump is energized so as to be closed is a minimum current value that can close the valve, so that the valve closing speed is reduced and thereby the vibration generated during valve closing control is inhibited. To determine the minimum current value, an actual fuel pressure of a pressure reservoir that stores the high-pressure fuel supplied from the high-pressure pump is compared to a target fuel pressure. The minimum current value is determined on the basis of a current value at which the deviation of the actual fuel pressure from the target fuel pressure exceeds a threshold value.

PRIOR ART LITERATURES

Patent Literature

Patent Literature 1: JP 2010-533820 A

SUMMARY OF INVENTION

The technique described in Patent Literature 1, however, may be affected by variations in characteristic of the high-pressure pump resulting from individual differences (manufacturing variability) and environmental changes. Thus, this technique may have difficulty in setting the minimum current value accurately and hence may not be able to reduce the noise of the high-pressure pump sufficiently.

The applicant of the present application has been studying a technique to reduce the noise from a high-pressure pump in a manner that is unlikely to be affected by individual differences and environmental changes, in the form of a system as described below. It is determined whether the high-pressure pump is operated (whether a movable portion of an electromagnetic valve is moved to a closed position) when the electromagnetic valve is energized. If it is determined that the high-pressure pump is operated, the electric power to be supplied to the electromagnetic valve is reduced by a predefined amount. This processing is repeated to reduce the supply power gradually. Then, if it is determined that the high-pressure pump is not operated, the supply power is increased by a predefined amount. In this manner, the supply power to the electromagnetic valve can be set to a valve-closing marginal power (a minimum supply power that can close the electromagnetic valve).

The system described above, however, requires the supply power to be reduced until it is determined that the high-pressure pump is not operated and thus may cause issues such as an intermittent noise resulting from the non-operation of the high-pressure pump and a reduction in fuel pressure.

An object of the present disclosure is to provide a control device for a high-pressure pump that can reduce a noise from the high-pressure pump while restricting issues resulting from non-operation of a high-pressure pump.

According to an aspect of the present disclosure, a high-pressure pump includes: a pump chamber having a suction port and a discharge port for fuel; a plunger configured to reciprocate in the pump chamber; a quantity control valve configured to open and close the suction port; and an electromagnetic valve configured to move the quantity control valve for opening and closing. The high-pressure pump is configured to energize the electromagnetic valve to move a movable portion of the electromagnetic valve to a closed position to close the quantity control valve. A control device for the high-pressure pump includes: a determination unit configured to determine whether the movable portion of the electromagnetic valve has been moved to the closed position to close the electromagnetic valve when the electromagnetic valve is energized; an acquisition unit configured to acquire, as an electromagnetic-valve response time, a period of time from a start of the energization of the electromagnetic valve until when it is determined that the electromagnetic valve has been closed; and an electric power setting unit configured to set a supply power to the electromagnetic valve by repeating a process in which the supply power to the electromagnetic valve is reduced so as to be smaller than a previous value until the electromagnetic-valve response time reaches a predefined upper limit value.

A reduction in supply power to the electromagnetic valve leads to a reduction in the valve closing speed of the electromagnetic valve (the moving speed of a movable portion), increasing electromagnetic-valve response time. Because of such a relationship, by monitoring the electromagnetic-valve response time during the energization of the electromagnetic valve and repeating processing in which the supply power to the electromagnetic valve is reduced so as to be smaller than a previous value until the electromagnetic-valve response time reaches a predefined upper limit value, the supply power to the electromagnetic valve can be reduced to a lower limit supply power that corresponds approximately to the upper limit value of the electromagnetic-valve response time. In this manner, the valve closing speed of the electromagnetic valve can be reduced and thereby the noise from the high-pressure pump can be reduced.

In this case, the supply power to the electromagnetic valve can be set to the lower limit supply power without being affected by variations in characteristic of the high-pressure pump (including variations in characteristic of the electromagnetic valve) resulting from individual differences and environmental changes. Thus, the noise from the high-pressure pump can be reduced without being affected significantly by the individual differences and environmental changes. Moreover, instead of reducing the supply power until it is determined that the high-pressure pump is not operated (that is, the electromagnetic valve does not close), the supply power is reduced until the electromagnetic-valve response time reaches its upper limit value; hence, issues such as intermittent noise resulting from the non-operation of the high-pressure pump and a reduction in fuel pressure can be restricted.

According to an aspect of the present disclosure, a high-pressure pump includes: a pump chamber having a suction port and a discharge port for fuel; a plunger configured to reciprocate in the pump chamber; a quantity control valve configured to open and close the suction port; and an electromagnetic valve configured to move the quantity control valve for opening and closing. The high-pressure pump is configured to energize the electromagnetic valve to move a movable portion of the electromagnetic valve to a closed position to close the quantity control valve. A control device for the high-pressure pump includes: a determination unit configured to determine whether the movable portion of the electromagnetic valve has been moved to the closed position to close the electromagnetic valve when the electromagnetic valve is energized; an acquisition unit configured to acquire, as an electromagnetic-valve response time, a period of time from a start of the energization of the electromagnetic valve until when it is determined that the electromagnetic valve has been closed; a target setting unit configured to set a target value of the electromagnetic-valve response time as a target electromagnetic-valve response time; and an electric power control unit configured to control a supply power to the electromagnetic valve such that the electromagnetic-valve response time becomes equal to the target electromagnetic-valve response time.

With such a configuration, the electromagnetic-valve response time can be controlled so as to agree with a desired target electromagnetic-valve response time accurately without being affected significantly by individual differences and environmental changes. Also in this manner, issues resulting from non-operation of the high-pressure pump can be restricted and the noise from the high-pressure pump can be reduced.

DESCRIPTION OF EMBODIMENTS

First Embodiment

A first embodiment will now be described with reference to FIGS. 1 to 12.

Figure 1:
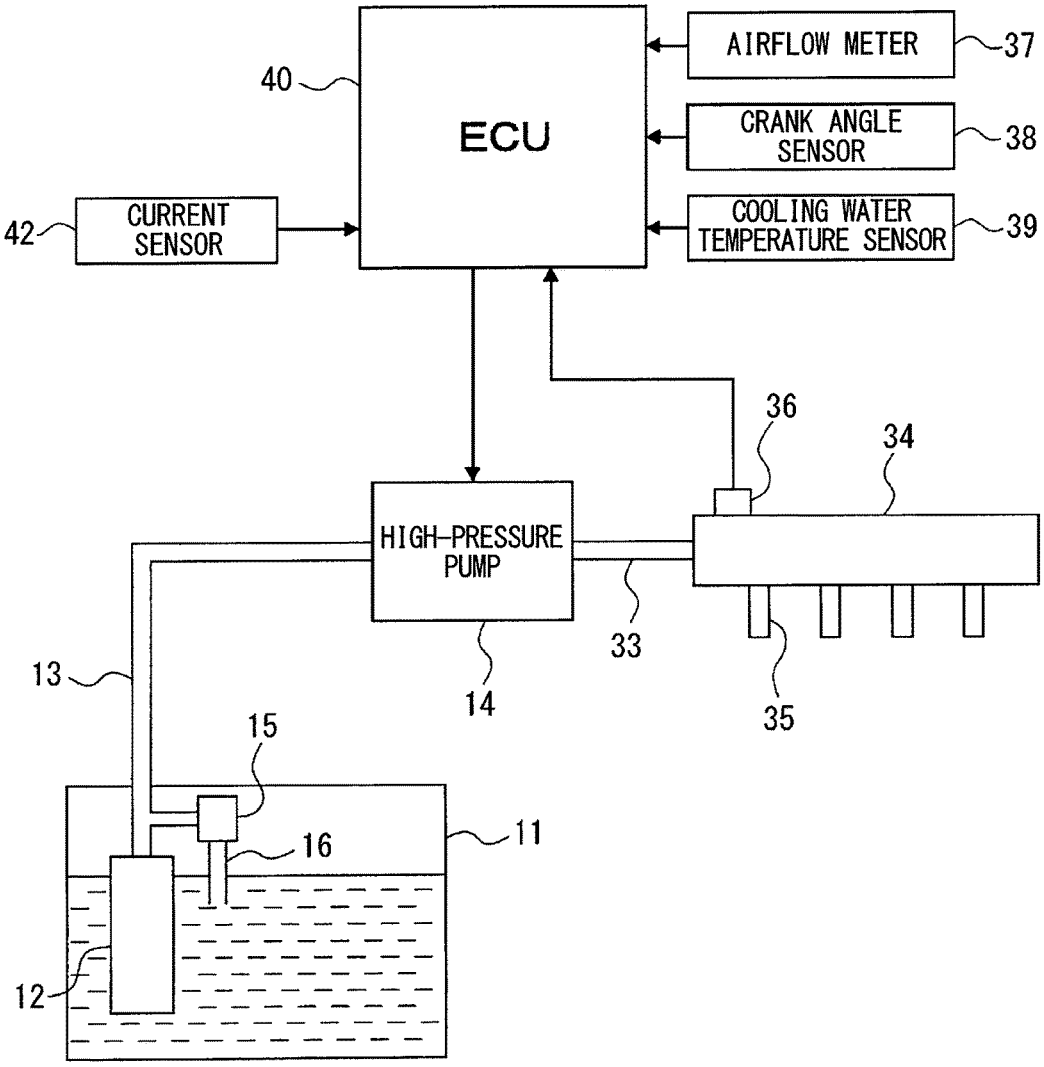
FIG. 1 is a diagram schematically illustrating a configuration of a fuel supply system of a direct injection engine according to a first embodiment.

As described in FIG. 1, a low-pressure pump 12 for bringing up fuel is disposed in a fuel tank 11, which stores the fuel. The low-pressure pump 12 is driven by an electric motor (not shown) that is operated on power from a battery (not shown). The low-pressure pump 12 discharges fuel, which is supplied to a high-pressure pump 14 through a fuel tube 13. The fuel tube 13 is connected to a pressure regulator 15, which regulates the discharge pressure of the low-pressure pump 12 (i.e., fuel supply pressure to the high-pressure pump 14) to a predefined pressure. Excess fuel causing the predefined pressure to be exceeded is returned to the fuel tank 11 through a fuel return tube 16.

Figure 2:
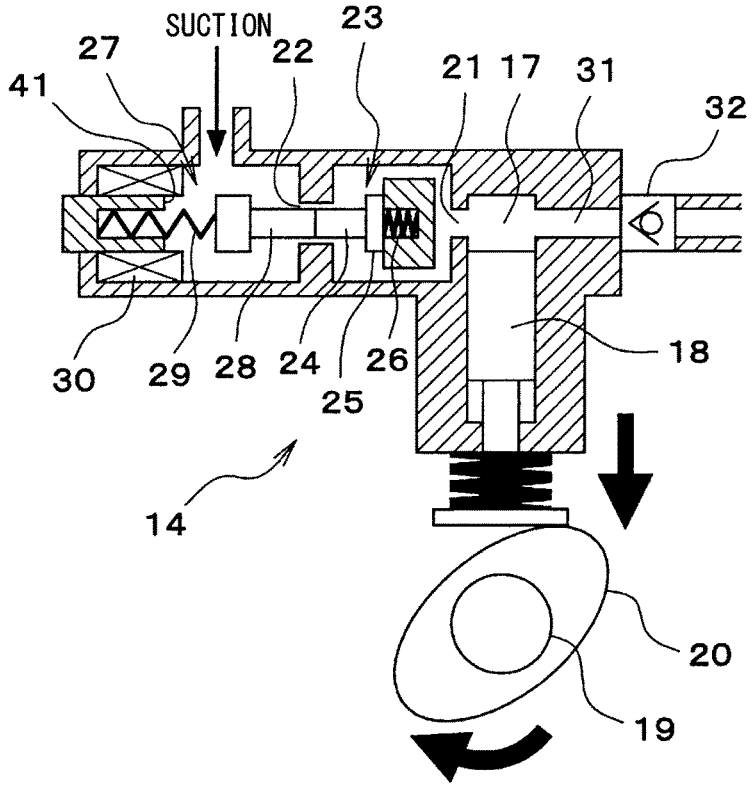
FIG. 2 is a schematic configuration diagram illustrating a high-pressure pump during fuel suction.
Figure 3:
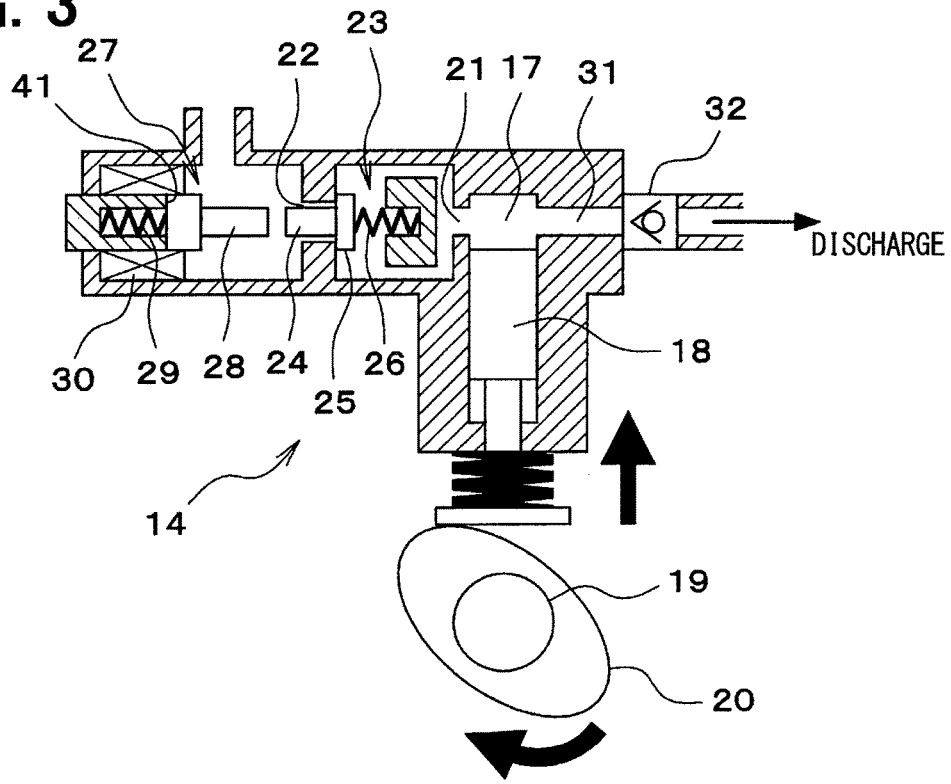
FIG. 3 is a schematic configuration diagram illustrating the high-pressure pump during fuel discharge.

As illustrated in FIGS. 2 and 3, the high-pressure pump 14, which is a plunger pump, includes a cylindrical pump chamber 17 and a plunger 18 to reciprocate in the pump chamber 17 to force fuel to come into and go out of the high-pressure pump 14. The plunger 18 is actuated by rotational motion of a cam 20 fitted to a cam shaft 19 of an engine. The high-pressure pump 14 has a suction port 21, which is provided with a quantity control valve 23 and an electromagnetic valve 27 (an electromagnetic actuator). The quantity control valve 23 opens and closes a fuel passageway 22. The electromagnetic valve 27 moves the quantity control valve 23 for the opening and closing.

The electromagnetic valve 27 includes a movable portion 28, a spring 29 that urges the movable portion 28 to an open position (see FIG. 2), and a solenoid 30 (a coil) that electromagnetically actuates the movable portion 28 to a closed position (see FIG. 3). The quantity control valve 23 includes a pressure portion 24 that is pressed by the movable portion 28 of the electromagnetic valve 27 toward a valve opening direction, a valve member 25 that opens and closes the fuel passageway 22, and a spring 26 that urges the valve member 25 toward a valve closing direction. The high-pressure pump 14 also has a discharge port 31, which is provided with a check valve 32 to prevent a back-flow of the discharged fuel.

As illustrated in FIG. 2, when the electromagnetic valve 27 is not energized (when energization of the solenoid 30 is turned off), the movable portion 28 is moved to the open position by the urging force of the spring 29 of the electromagnetic valve 27. Then, the movable portion 28 presses the pressure portion 24 of the quantity control valve 23 and thus moves the valve member 25 toward the valve opening direction to open, thereby opening the fuel passageway 22.

As illustrated in FIG. 3, when the electromagnetic valve 27 is energized (when energization of the solenoid 30 is turned on), the movable portion 28 is moved to the closed position by the electromagnetic attracting force of the solenoid 30 of the electromagnetic valve 27. Then, the valve member 25 is moved by the urging force of the spring 26 of the quantity control valve 23 toward the valve closing direction to close, thereby closing the fuel passageway 22.

The energization of the electromagnetic valve 27 (the solenoid 30) is controlled to achieve the following. As illustrated in FIG. 2, in a suction stroke of the high-pressure pump 14 (when the plunger 18 is lowered), the valve member 25 of the quantity control valve 23 is opened to admit fuel into the pump chamber 17. As illustrated in FIG. 3, in a discharge stroke of the high-pressure pump 14 (when the plunger 18 is raised), the valve member 25 of the quantity control valve 23 is closed to discharge the fuel from the pump chamber 17.

Here, the timing to start energizing the electromagnetic valve 27 (the solenoid 30) is controlled to control a period over which the quantity control valve 23 is closed and thereby control the quantity of fuel to be discharged from the high-pressure pump 14 and thus the fuel pressure. To increase the fuel pressure, for example, the timing to start energizing the electromagnetic valve 27 is advanced, so that the timing to start closing the quantity control valve 23 is advanced. In this way, the period over which the quantity control valve 23 is closed is prolonged and thereby the discharge flow rate of the high-pressure pump 14 is increased. To reduce the fuel pressure, the timing to start energizing the electromagnetic valve 27 is retarded, so that the timing to start closing the quantity control valve 23 is retarded. In this way, the period over which the quantity control valve 23 is closed is shortened and thereby the discharge flow rate of the high-pressure pump 14 is reduced.

As illustrated in FIG. 1, fuel discharged by the high-pressure pump 14 is fed through a high-pressure fuel tube 33 to a delivery pipe 34, from which the high-pressure fuel is distributed to a fuel injection valve 35 attached to each cylinder of the engine. The delivery pipe 34 (or the high-pressure fuel tube 33) is provided with a fuel pressure sensor 36, which senses fuel pressure in a high-pressure fuel passageway, such as the high-pressure fuel tube 33 and the delivery pipe 34.

The engine is also provided with an airflow meter 37, which measures the quantity of intake air, and a crank angle sensor 38, which outputs a pulse signal for every predefined crank angle in synchronization with the rotation of a crankshaft (not shown). The crank angle and the engine rotation speed are sensed on the basis of the output signal of the crank angle sensor 38. Furthermore, a cooling water temperature sensor 39 for sensing the temperature of a cooling water (cooling water temperature) is disposed at a cylinder block of the engine. A current sensor 42 senses the current passing through the electromagnetic valve 27 (the solenoid 30) of the high-pressure pump 14.

The output of such sensors is input to an electronic control unit (hereinafter referred to as an ECU) 40. The ECU 40, which includes a microcomputer as its main component, executes various engine control programs stored in a built-in ROM (a storage medium) to control the quantity of fuel injection, ignition timing, throttle opening (the quantity of intake air), and the like in accordance with the operating conditions of the engine.

Figure 4:
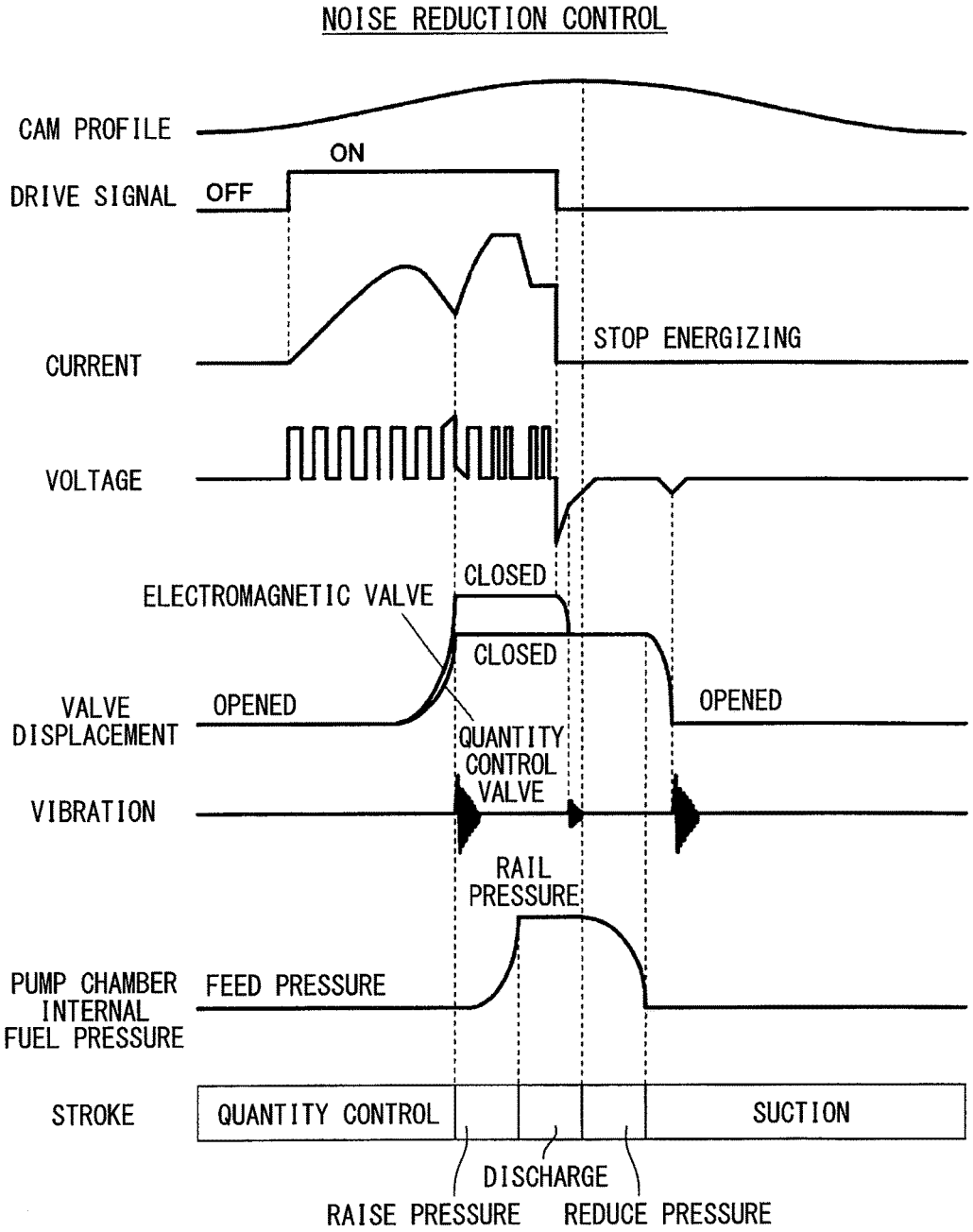
FIG. 4 is a time chart for describing noise reduction control.
Figure 5:
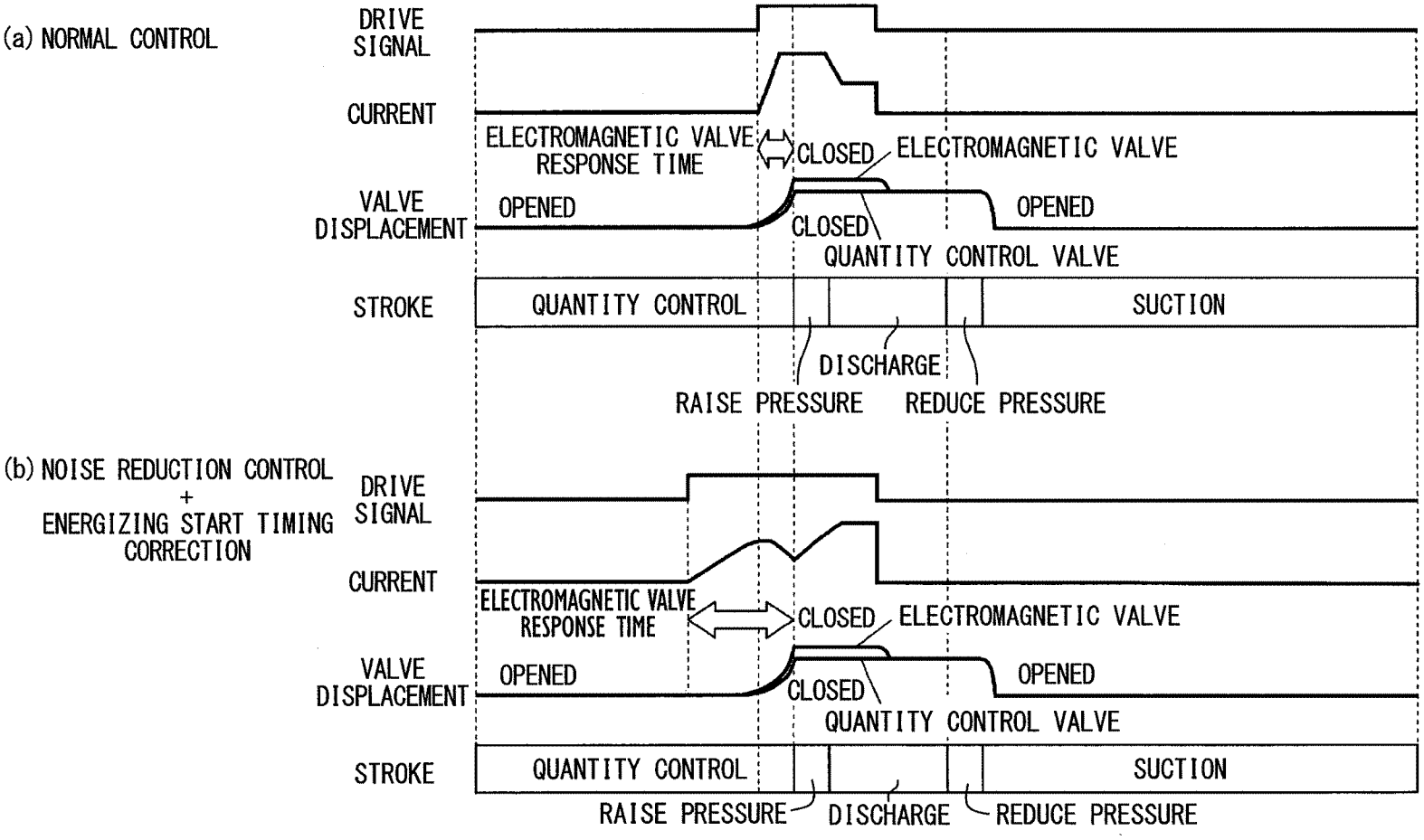
FIG. 5 is a time chart for comparing normal control and the noise reduction control.

As shown in FIGS. 4 and 5, during valve closing control to close the quantity control valve 23 of the high-pressure pump 14, the ECU 40 causes an actuating current to pass through the solenoid 30 of the electromagnetic valve 27 to move the movable portion 28 of the electromagnetic valve 27 from the open position to the closed position and thereby close the quantity control valve 23. Then, during valve opening control to open the quantity control valve 23 of the high-pressure pump 14, the ECU 40 stops energizing the solenoid 30 of the electromagnetic valve 27 to move the movable portion 28 of the electromagnetic valve 27 from the closed position to the open position and thereby open the quantity control valve 23.

During the valve closing control, the movable portion 28 of the electromagnetic valve 27 may strike a stopper portion 41 (see FIGS. 2 and 3), generating a vibration and thereby an unpleasant noise. A driver is likely to hear this noise while, for example, driving at a low speed or at a standstill.

In the present embodiment, normal control is performed when a predefined condition to execute noise reduction control is unsatisfied (for example, when the noise generated during the valve closing control on the high-pressure pump 14 is unlikely to be heard by a driver). As illustrated in (a) of FIG. 5, in the case of the normal control, a voltage to actuate the solenoid 30 of the electromagnetic valve 27 is kept on in the valve closing control, so that a current to actuate the solenoid 30 is increased swiftly. In this manner, the electromagnetic attracting force of the solenoid 30 is increased swiftly and thereby the movable portion 28 is moved to the closed position swiftly and the quantity control valve 23 is closed swiftly.

The noise reduction control is performed when the predefined condition to execute the noise reduction control is satisfied (for example, when the noise generated during the valve closing control on the high-pressure pump 14 is likely to be heard by a driver) to reduce the noise generated during the valve closing control. As illustrated in FIG. 4, in the case of the noise reduction control, PWM control is performed to periodically switch on and off the voltage to actuate the solenoid 30 of the electromagnetic valve 27 during the valve closing control, so that the supply power to the solenoid 30 of the electromagnetic valve 27 is reduced so as to be lower than that provided during the normal control. In this manner, the electromagnetic attracting force of the solenoid 30 is reduced so as to be smaller than that provided during the normal control and thereby the moving speed of the movable portion 28 is reduced. Thus, the vibration generated during the striking of the movable portion 28 against the stopper portion 41 is inhibited and thereby the noise generated during the valve closing control is reduced.

Here, the ECU 40 executes routines in FIGS. 9 to 11, to be described hereinafter, to set the supply power to the solenoid 30 of the electromagnetic valve 27 (hereinafter referred to as the supply power to the electromagnetic valve 27) in the following manner in the first embodiment.

When the electromagnetic valve 27 is energized (when the solenoid 30 is energized), it is determined whether the movable portion 28 of the electromagnetic valve 27 has been moved to the closed position (hereinafter referred to as "the electromagnetic valve 27 has been closed"). A period of time from start of the energization of the electromagnetic valve 27 until when it is determined that the electromagnetic valve 27 has been closed is acquired as an electromagnetic-valve response time. Then, processing is repeated in which the supply power to the electromagnetic valve 27 is reduced so as to be smaller than a previous value until the electromagnetic-valve response time reaches a predefined upper limit value to set the supply power to the electromagnetic valve 27.

The upper limit value of the electromagnetic-valve response time is preset to an electromagnetic-valve response time with which the supply power to the electromagnetic valve 27 is a minimum supply power that can close the electromagnetic valve 27 or a value shorter than that by a predefined value, on the basis of the characteristic of the electromagnetic valve 27 (for example, an electromagnetic valve having a standard characteristic).

Figure 6:
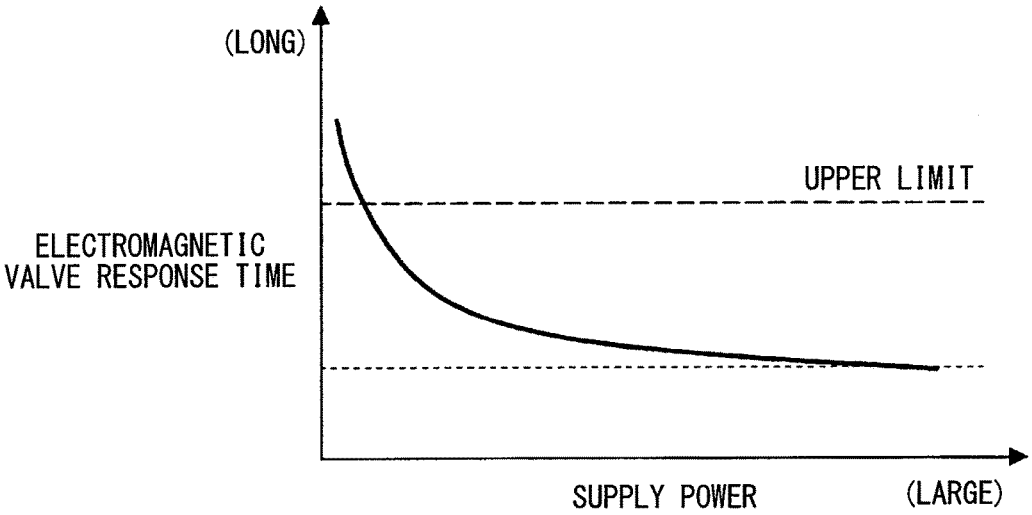
FIG. 6 is a diagram illustrating the relationship between supply power and an electromagnetic-valve response time.

As illustrated in FIG. 6, a reduction in the supply power to the electromagnetic valve 27 leads to a reduction in the valve closing speed of the electromagnetic valve 27 (the moving speed of the movable portion 28), increasing the electromagnetic-valve response time. Because of such a relationship, by monitoring the electromagnetic-valve response time during the energization of the electromagnetic valve 27 and repeating the processing in which the supply power to the electromagnetic valve 27 is reduced so as to be smaller than a previous value until the electromagnetic-valve response time reaches the upper limit value, the supply power to the electromagnetic valve 27 can be reduced to a lower limit supply power that corresponds approximately to the upper limit value of the electromagnetic-valve response time. In this manner, the valve closing speed of the electromagnetic valve 27 can be reduced and thereby the noise from the high-pressure pump 14 can be reduced.

A method to determine whether the electromagnetic valve 27 has been closed will now be described.

Figure 7:
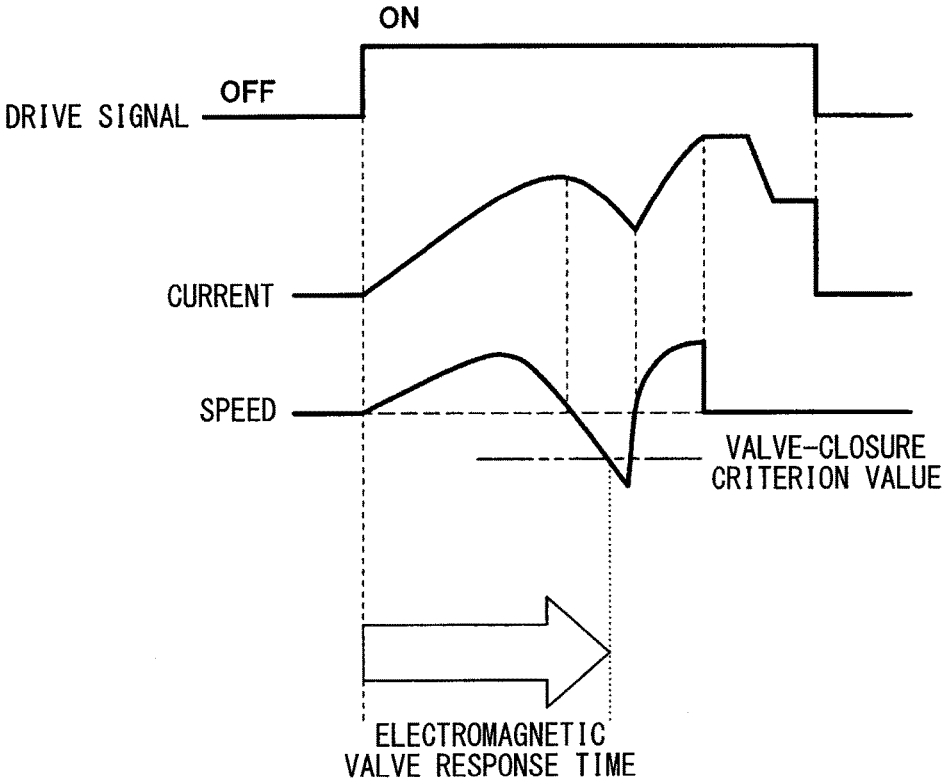
FIG. 7 is a time chart for describing a method of determining that an electromagnetic valve has been closed.

As illustrated in FIG. 7, when the electromagnetic valve 27 is energized, the current increases until the movable portion 28 starts moving. The current decreases when the movable portion 28 starts moving, because, as the movable portion 28 approaches the solenoid 30, the inductance of the solenoid 30 increases. Then, the current increases again when the movable portion 28 stops moving at the closed position (a position in which the movable portion 28 comes in contact with the stopper portion 41) because the inductance becomes constant. That is, when the electromagnetic valve 27 is energized, the current increases, before it starts decreasing when the movable portion 28 starts moving. Then, the current starts increasing when the electromagnetic valve 27 is closed (when the movable portion 28 has moved to the closed position).

Because of such a characteristic, the current through the solenoid 30 of the electromagnetic valve 27 is sensed by the current sensor 42, the speed of the current (for example, a differentiated value) is calculated, and it is determined that the electromagnetic valve 27 has been closed (the movable portion 28 has moved to the closed position) when the speed of the current falls below a predefined valve-closure criterion value in the first embodiment.

Additionally, in the first embodiment, to reduce the supply power to the electromagnetic valve 27 until the electromagnetic-valve response time reaches the upper limit value, processing is performed, if the electromagnetic-valve response time is shorter than the upper limit value, in the following manner: the supply power to the electromagnetic valve 27 is reduced so as to be smaller than a previous value each time when the number of times determining that the electromagnetic valve 27 has been closed reaches a predefined determination count.

Figure 8:
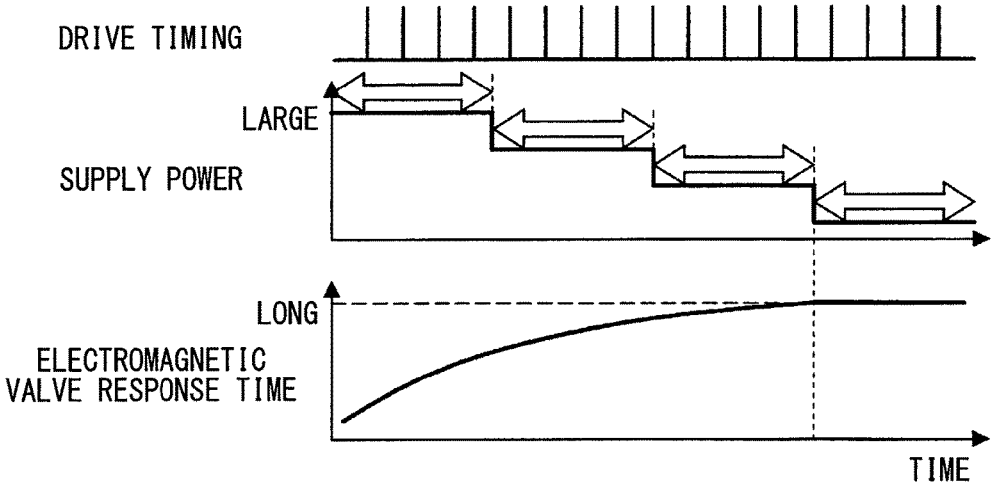
FIG. 8 is a time chart for describing a method of setting a determination count.
Figure 8:
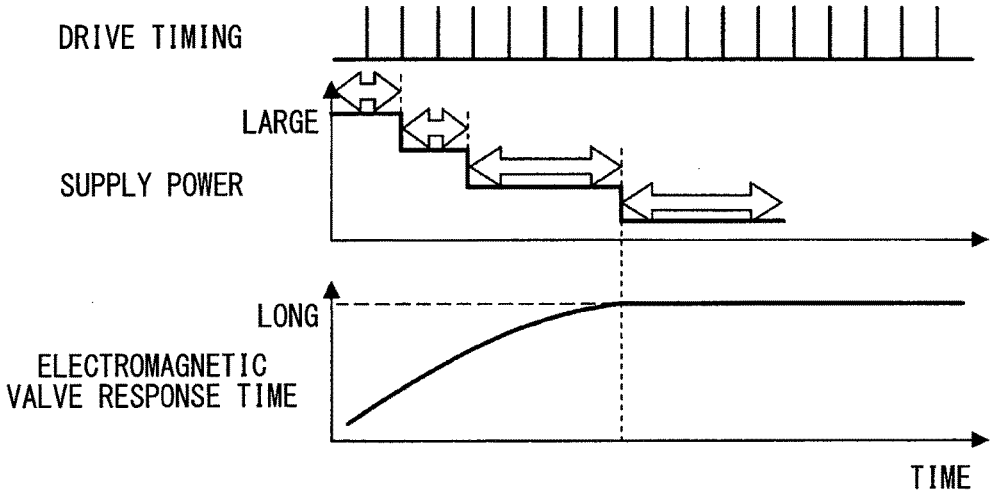

Here, in case where the determination count is a constant value as illustrated in (a) of FIG. 8, if the determination count is increased, the reliability of the determination that the electromagnetic valve 27 has been closed can be secured. In this case, however, the supply power to the electromagnetic valve 27 cannot be reduced swiftly. Thus, the time taken to reduce the supply power to the electromagnetic valve 27 so as to be the lower limit supply power (that is, the time taken for the electromagnetic-valve response time to reach the upper limit value) is prolonged.

Hence, in the first embodiment, as illustrated in (b) of FIG. 8, the determination count is increased as the electromagnetic-valve response time becomes longer (or the determination count is increased as the supply power to the electromagnetic valve 27 is reduced). In this way, when the supply power to the electromagnetic valve 27 is still large with a short electromagnetic-valve response time, the determination count is reduced, so that the supply power to the electromagnetic valve 27 is reduced swiftly. Subsequently, when the supply power to the electromagnetic valve 27 becomes small with a long electromagnetic-valve response time and a region in which the electromagnetic valve 27 does not close is approaching, the determination count is increased, so that the reliability of the valve closure determination on the electromagnetic valve 27 is enhanced.

The routines in the FIGS. 9 to 11 to be executed by the ECU 40 in the first embodiment will now be described.

[Valve Closing Control Routine]

Figure 9:
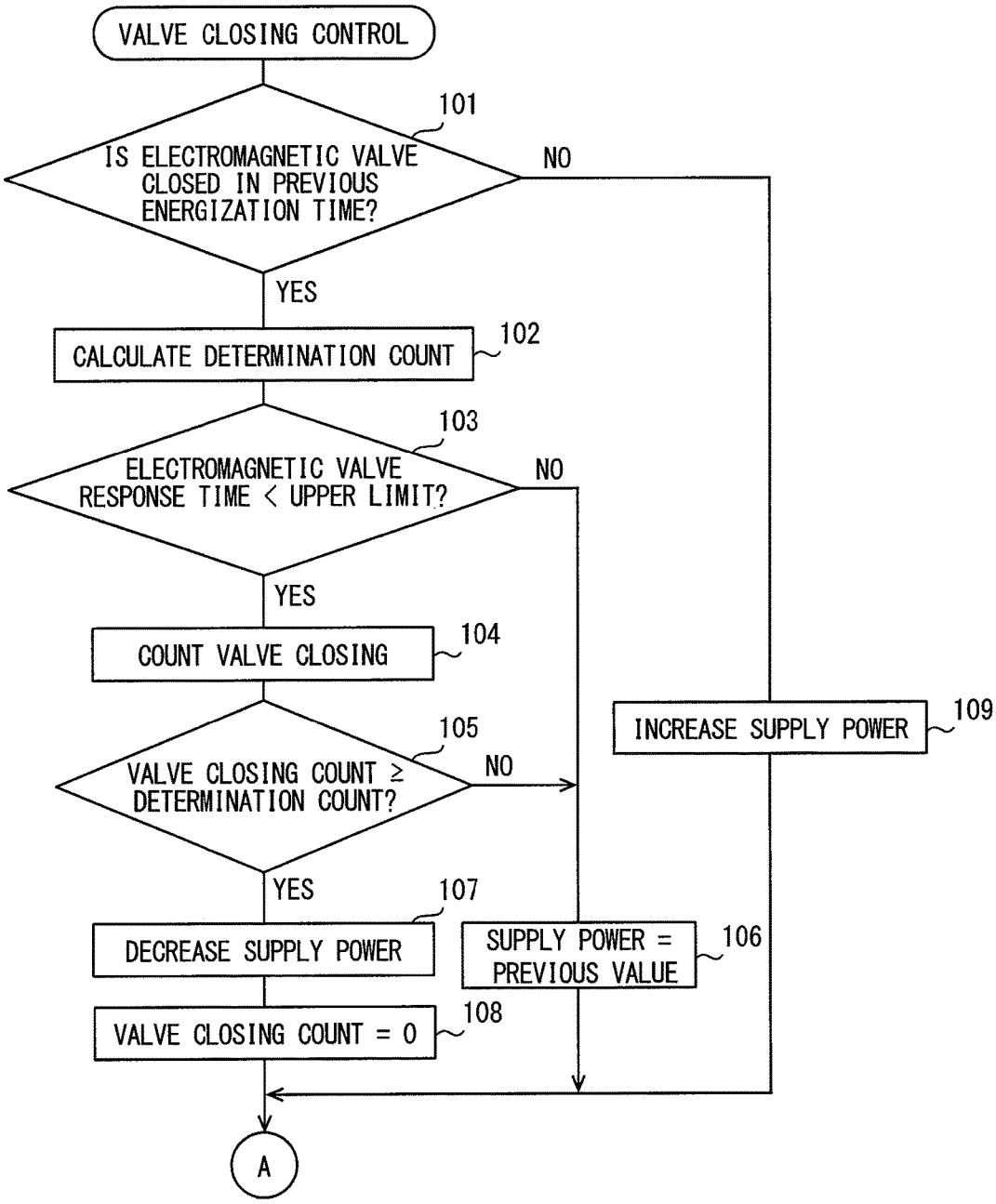
FIG. 9 is a first flowchart illustrating a processing flow of a valve closing control routine.
Figure 10:
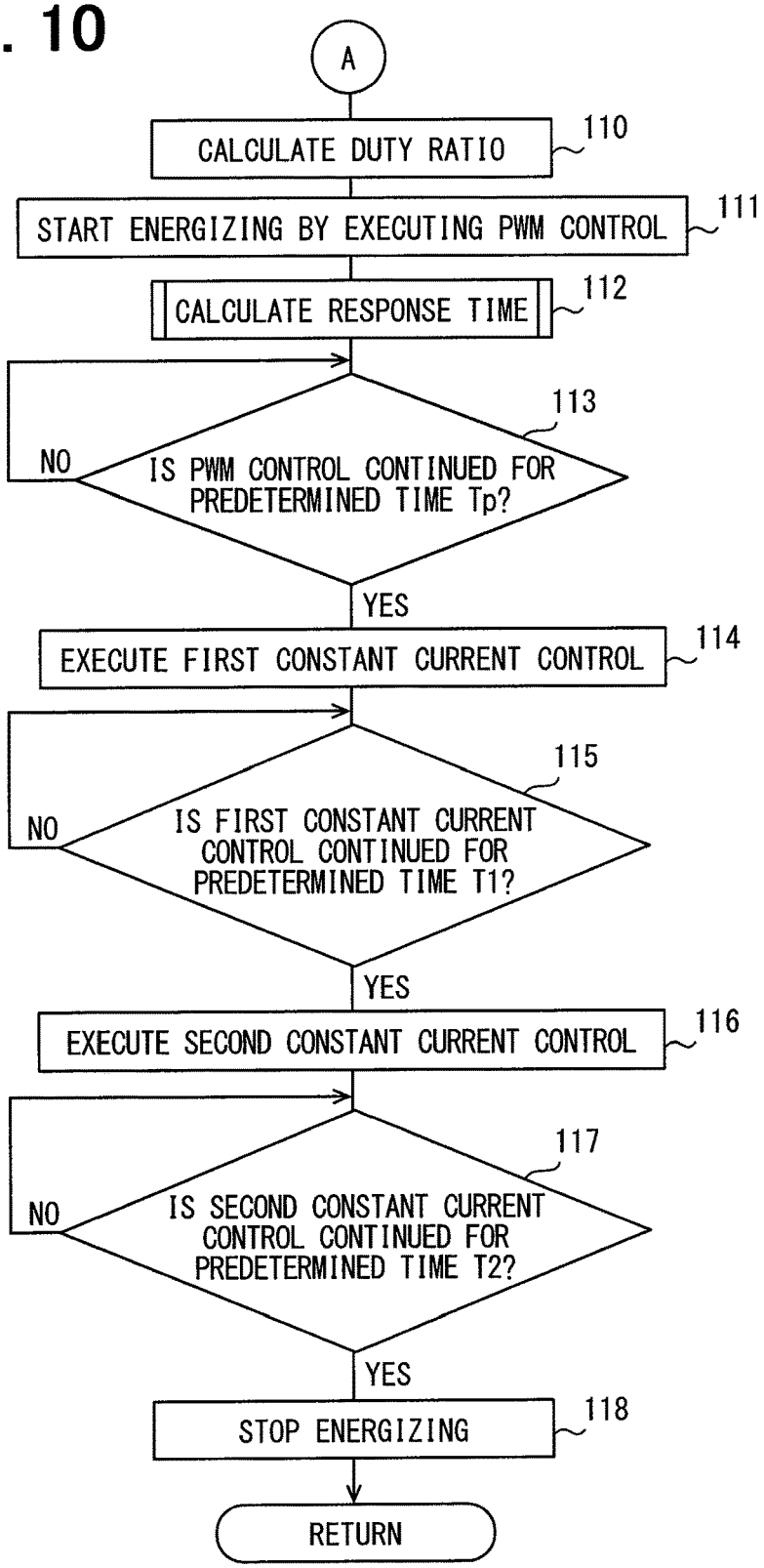
FIG. 10 is a second flowchart illustrating the processing flow of the valve closing control routine.

A valve closing control routine described in FIGS. 9 and 10 is executed by the ECU 40 repeatedly with a predefined period, when the predefined condition to execute the noise reduction control is satisfied. When this routine is started, it is determined in step 101 whether the electromagnetic valve 27 has been closed during the previous energization on the basis of whether a valve closure determination flag FCL, to be described hereinafter, is "1."

If it is determined in step 101 that the electromagnetic valve 27 has been closed during the previous energization, the routine proceeds to step 102. In step 102, the determination count is calculated in accordance with the electromagnetic-valve response time (or the supply power) exhibited during the previous energization by referencing a table of the determination count illustrated in FIG. 12. The table of the determination count is set such that the determination count increases with an increase in the electromagnetic-valve response time (or a reduction in the supply power).

The table of the determination count is prepared in advance on the basis of test data, design data, or the like and stored in the ROM of the ECU 40.

Then, the routine proceeds to step 103, where it is determined whether the electromagnetic-valve response time during the previous energization is shorter than the predefined upper limit value. Here, the upper limit value is preset to an electromagnetic-valve response time with which the supply power to the electromagnetic valve 27 is a minimum supply power that can close the electromagnetic valve 27 or a value shorter than that by a predefined value, on the basis of the characteristic of the electromagnetic valve 27 (for example, an electromagnetic valve having a standard characteristic).

If it is determined in step 103 that the electromagnetic-valve response time is less than the upper limit value, it is determined that the electromagnetic-valve response time has not reached the upper limit value. Then, the routine proceeds to step 104, where the consecutive number of times it is determined that the electromagnetic valve 27 has been closed is counted as the valve closing count.

Then, the routine proceeds to step 105, where it is determined whether the valve closing count is equal to or greater than the determination count. If it is determined in step 105 that the valve closing count is less than the determination count, the routine proceeds to step 106, where the forthcoming supply power to the electromagnetic valve 27 is set to a value identical with the previous value.

Subsequently, if it is determined in step 105 described above that the valve closing count is equal to or greater than the determination count, the routine proceeds to step 107, where the forthcoming supply power to the electromagnetic valve 27 is set to a value obtained by reducing the previous value by a predefined value. Then, the routine proceeds to step 108, where the valve closing count is reset to "0."

Subsequently, if it is determined in step 103 described above that the electromagnetic-valve response time is equal to or greater than the upper limit value, it is determined that the electromagnetic-valve response time has reached the upper limit value. Then, the routine proceeds to step 106, where the supply power is set to a value identical with the previous value.

In this manner, the processing to reduce the supply power to the electromagnetic valve 27 from a previous value is repeated every time the valve closing count reaches the determination count until the electromagnetic-valve response time reaches the upper limit value. The processing from steps 101 to 108 serves as an electric power setting unit.

If it is determined in step 101 described above that the electromagnetic valve 27 has not been closed during the previous energization, the routine proceeds to step 109, where the supply power is set to a value obtained by increasing the previous value by a predefined value.

Subsequently, the routine proceeds to step 110 in FIG. 10, where a duty ratio (the ratio of on/off of the voltage to actuate the solenoid 30) corresponding to the supply power set in one of steps 106, 107, and 109 described above is calculated.

Then, the routine proceeds to step 111, where, when the timing to start the energization of the electromagnetic valve 27 is reached, the energization of the electromagnetic valve 27 is started with the PWM control being performed to periodically switch on and off the voltage to actuate the solenoid 30 of the electromagnetic valve 27 at the duty ratio set in step 110 described above.

As illustrated in FIG. 5, during the noise reduction control, the timing to start the energization is advanced in accordance with the supply power, such that the timing to start the energization is advanced commensurately with the increase in the electromagnetic-valve response time in comparison with the normal control. In this manner, a delay to the timing at which the valve is closed due to a reduction in the supply power to the electromagnetic valve 27 (an increase in the electromagnetic-valve response time) is prevented, and the quantity to be discharged by the high-pressure pump 14 can be secured.

Then, the routine proceeds to step 112, where a response time calculation routine in FIG. 11, to be described hereinafter, is executed to determine whether the electromagnetic valve 27 has been closed during the energization of the electromagnetic valve 27. The period of time from start of the energization of the electromagnetic valve 27 until when it is determined that the electromagnetic valve 27 has been closed is acquired as the electromagnetic-valve response time.

Then, the routine proceeds to step 113, where it is determined whether the PWM control has been continued for a predefined time Tp (or whether the current through the solenoid 30 exceeds a predefined value I1). At a point in time when it is determined in step 113 that the PWM control has been continued for the predefined time Tp (or when it is determined that the current through the solenoid 30 exceeds the predefined value I1), the routine proceeds to step 114, where the PWM control is switched to a first constant current control and the first constant current control is performed. In the first constant current control, the current passing through the solenoid 30 is set to the predefined value I1.

Then, the routine proceeds to step 115, where it is determined whether the first constant current control has been continued for a predefined time T1. At a point in time when it is determined that the first constant current control has been continued for the predefined time T1, the routine proceeds to step 116, where the first constant current control is switched to a second constant current control and the second constant current control is performed. In the second constant current control, the current passing through the solenoid 30 is set to a predefined value I2, which is less than the predefined value I1.

Then, the routine proceeds to step 117, where it is determined whether the second constant current control has been continued for a predefined time T2. At a point in time when it is determined that the second constant current control has been continued for the predefined time T2, the routine proceeds to step 118, where the energization of the electromagnetic valve 27 is stopped, and this routine is finished.

[Response Time Calculation Routine]

Figures 11, 12:
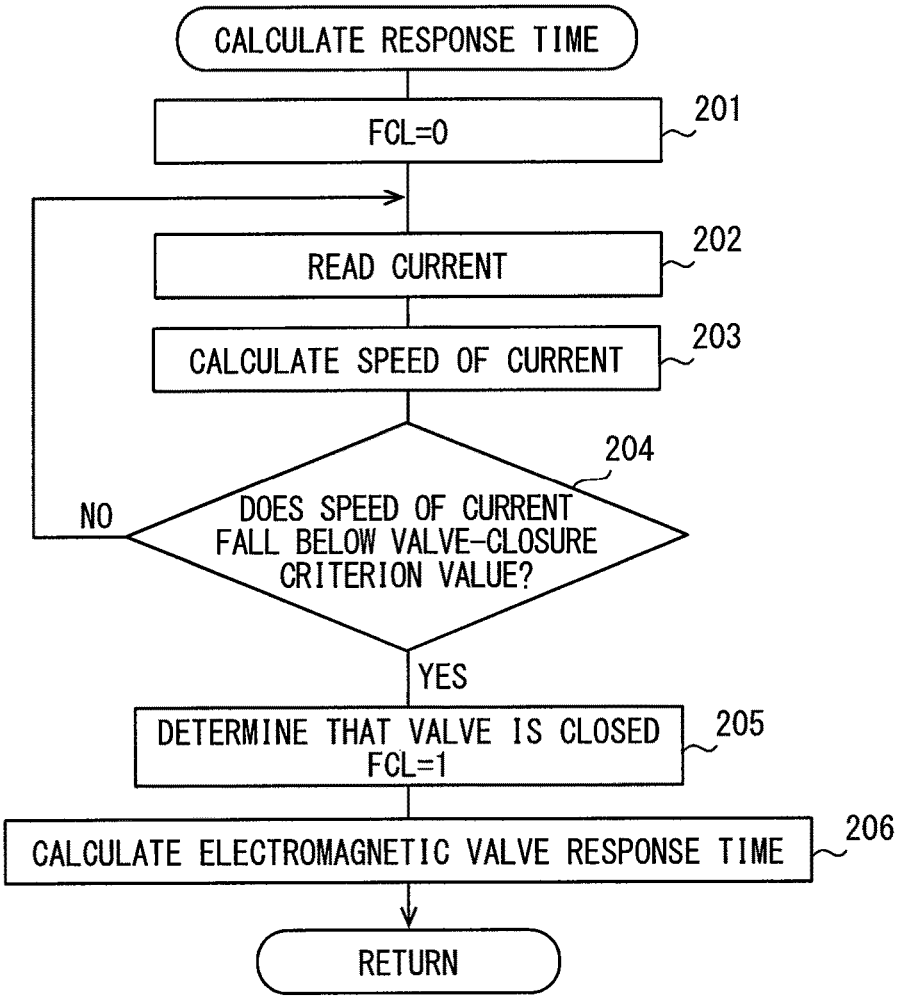
FIG. 11 is a flowchart illustrating a processing flow of a response time calculation routine.
FIG. 12 is a diagram conceptually illustrating an example table of the determination count.

The response time calculation routine described in FIG. 11 is a subroutine to be executed in step 112 of the valve closing control routine described in FIGS. 9 and 10 and serves as a determination unit and an acquisition unit. When this routine is started, the valve closure determination flag FCL is reset to "0" in step 201.

Then, the routine proceeds to step 202, where the current passing through the solenoid 30 and detected by the current sensor 42 is read. Then, the routine proceeds to step 203, where the speed of the current passing through the solenoid 30 (for example, a differentiated value) is calculated.

Then, the routine proceeds to step 204, where it is determined whether the speed of the current passing through the solenoid 30 falls below the predefined valve-closure criterion value. If the speed of the current passing through the solenoid 30 is not less than the valve-closure criterion value, the routine reverts back to step 202 described above.

At a point in time when it is determined in step 204 described above that the speed of the current passing through the solenoid 30 is less than the valve-closure criterion value, the routine proceeds to step 205. In step 205, it is determined that the electromagnetic valve 27 has been closed (the movable portion 28 has moved to the closed position), and the valve closure determination flag FCL is set to "1."

Then, the routine proceeds to step 206, where the period of time from start of the energization of the electromagnetic valve 27 until when it is determined that the electromagnetic valve 27 has been closed is calculated as the electromagnetic-valve response time, and this routine is finished.

In the first embodiment described above, the noise reduction control is executed when a predefined condition to execute the noise reduction control is satisfied. During the noise reduction control, it is determined whether the electromagnetic valve 27 has been closed during the energization of the electromagnetic valve 27, and a period of time from start of the energization of the electromagnetic valve 27 until when it is determined that the electromagnetic valve 27 has been closed is acquired as the electromagnetic-valve response time. Then, processing is repeated in which the supply power to the electromagnetic valve 27 is reduced so as to be smaller than a previous value until the electromagnetic-valve response time reaches a predefined upper limit value to set the supply power to the electromagnetic valve 27. In this manner, the supply power to the electromagnetic valve 27 can be reduced to a lower limit supply power that corresponds approximately to the upper limit value of the electromagnetic-valve response time. Thus, the valve closing speed of the electromagnetic valve 27 can be reduced and thereby the noise from the high-pressure pump 14 can be reduced.

In this case, the supply power to the electromagnetic valve 27 can be set to the lower limit supply power without being affected even by variations in characteristic of the high-pressure pump 14 (including variations in characteristic of the electromagnetic valve 27) resulting from individual differences and environmental changes. Thus, the noise from the high-pressure pump 14 can be reduced without being affected significantly by the individual differences and environmental changes. Moreover, instead of reducing the supply power until it is determined that the high-pressure pump 14 is not operated (that is, the electromagnetic valve 27 does not close), the supply power is reduced until the electromagnetic-valve response time reaches its upper limit value; hence, issues such as intermittent noise resulting from the non-operation of the high-pressure pump 14 and a reduction in fuel pressure can be prevented.

Additionally, in the first embodiment, to reduce the supply power to the electromagnetic valve 27 until the electromagnetic-valve response time reaches the upper limit value, processing is performed, if the electromagnetic-valve response time is shorter than the upper limit value, in the following manner: the supply power to the electromagnetic valve 27 is reduced so as to be smaller than a previous value every time when the number of times it is determined that the electromagnetic valve 27 has been closed reaches a predefined determination count. In this manner, the supply power to the electromagnetic valve 27 can be reduced after the number of times determining that the electromagnetic valve 27 has been closed reaches a predefined determination count and it is thereby ensured that the electromagnetic valve 27 is closed with the supply power provided this time.

Furthermore, in the first embodiment, the determination count is increased as the electromagnetic-valve response time becomes longer or the determination count is increased with a reduction in the supply power to the electromagnetic valve 27. In this way, when the supply power to the electromagnetic valve 27 is still large with a short electromagnetic-valve response time, the determination count is reduced, so that the supply power to the electromagnetic valve 27 can be reduced swiftly. Subsequently, when the supply power to the electromagnetic valve 27 becomes small with a long electromagnetic-valve response time and a region in which the electromagnetic valve 27 does not close is approaching, the determination count is increased, so that the reliability of the valve closure determination on the electromagnetic valve 27 can be enhanced. In this manner, the time taken to reduce the supply power to the electromagnetic valve 27 to a lower limit supply power can be reduced while the reliability of the valve closure determination on the electromagnetic valve 27 is maintained. Thus, the noise from the high-pressure pump 14 can be reduced swiftly.

Additionally, in the first embodiment, the upper limit value of the electromagnetic-valve response time is preset to an electromagnetic-valve response time with which the supply power to the electromagnetic valve 27 is a minimum supply power that can close the electromagnetic valve 27 or a value shorter than that by a predefined value, on the basis of the characteristic of the electromagnetic valve 27 (for example, an electromagnetic valve having a standard characteristic). In this manner, the supply power to the electromagnetic valve 27 can be reduced to approximately a minimum supply power (the minimum supply power or its vicinity). Thus, the effect of reducing the noise from the high-pressure pump 14 can be enhanced.

While the determination count is changed in accordance with the electromagnetic-valve response time (or the supply power) in the first embodiment described above, this is not limitative. The determination count may be fixed to a constant value. Furthermore, the processing to determine the valve closing count may be omitted and the supply power to the electromagnetic valve 27 may be reduced so as to be smaller than a previous value every time when it is determined that the electromagnetic valve 27 is closed (or every time when a predefined period of time elapses) until the electromagnetic-valve response time reaches the upper limit value.

Second Embodiment

A second embodiment will now be described with reference to FIGS. 13 to 18. Components substantially identical with or similar to those in the first embodiment are designated with identical symbols and the description thereof will be omitted or simplified, so that differences from the first embodiment will be mainly described.

In the second embodiment, an ECU 40 executes routines in FIGS. 13 to 16, to be described hereinafter, to set a target value for an electromagnetic-valve response time as a target electromagnetic-valve response time and to control supply power of an electromagnetic valve 27 such that the electromagnetic-valve response time becomes equal to the target electromagnetic-valve response time during the noise reduction control. In the second embodiment, the target electromagnetic-valve response time is set such that overheating of the electromagnetic valve 27 is prevented.

The routines in the FIGS. 13 to 16 to be executed by the ECU 40 in the second embodiment will now be described.

[Fuel Pressure F/F Control Quantity Calculation Routine]

Figure 13:
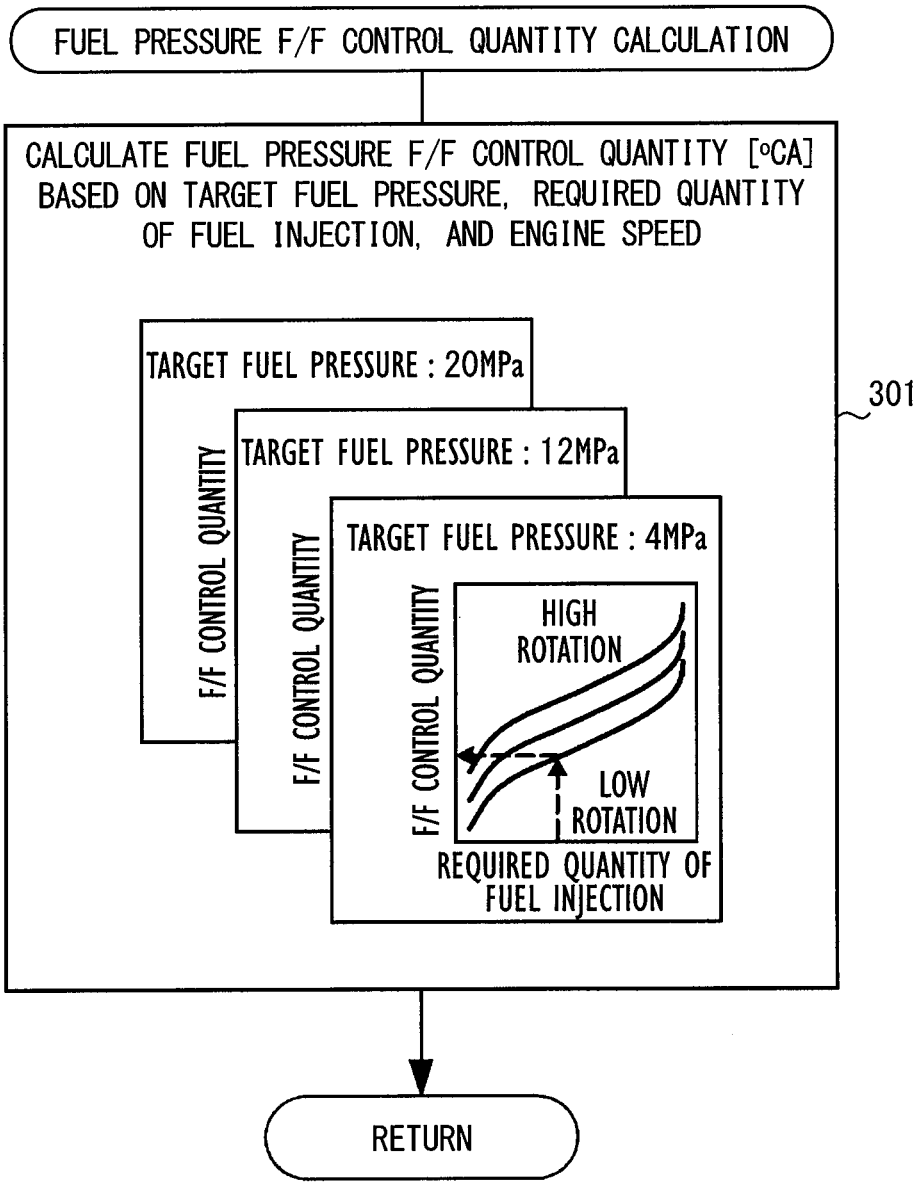
FIG. 13 is a flowchart illustrating a processing flow of a fuel pressure F/F control quantity calculation routine.

A fuel pressure F/F control quantity calculation routine described in FIG. 13 is executed by the ECU 40 repeatedly with a predefined period. Here, "F/F" refers to "feed/forward."

When this routine is started, a fuel pressure F/F control quantity [° CA] is calculated in step 301 from a map or the like in accordance with a target fuel pressure, a required quantity of fuel injection, engine rotation speed, and the like. The target fuel pressure and the required quantity of fuel injection are each calculated from a map or the like in accordance with operating conditions of the engine (for example, engine rotation speed, load, and the like).

[Fuel Pressure F/B Control Quantity Calculation Routine]

Figure 14:
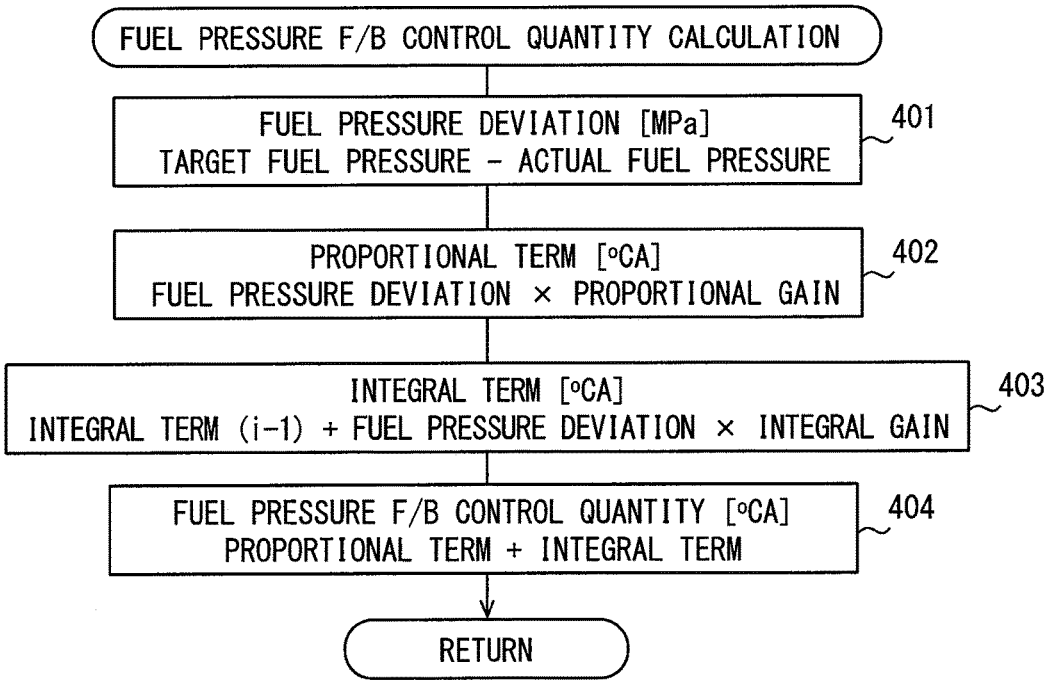
FIG. 14 is a flowchart illustrating a processing flow of a fuel pressure F/B control quantity calculation routine.

A fuel pressure F/B control quantity calculation routine described in FIG. 14 is executed by the ECU 40 repeatedly with a predefined period. Here, "F/B" refers to "feed/back."

When this routine is started, a deviation of an actual fuel pressure (a fuel pressure sensed by the fuel pressure sensor 36) from a target fuel pressure is calculated as a fuel pressure deviation [MPa] in step 401.

Fuel pressure deviation=Target fuel pressure−Actual fuel pressure

Then, the routine proceeds to step 402, where the fuel pressure deviation is multiplied by a proportional gain to obtain a proportional term [° CA].

Proportional term=Fuel pressure deviation×Proportional gain

Then, the routine proceeds to step 403, where the integral term [° CA] for this time is calculated using the fuel pressure deviation, an integral gain, and the previous integral term (i−1) on the basis of the following equation.

Integral term=Integral term ($i$−1)+Fuel pressure deviation×Integral gain

Then, the routine proceeds to step 404, where the fuel pressure F/B control quantity [° CA] is calculated using the proportional term and the integral term on the basis of the following equation.

Fuel pressure *F/B* control quantity=Proportional term+Integral term

[Target Electromagnetic-Valve Response Time Calculation Routine]

Figure 15:
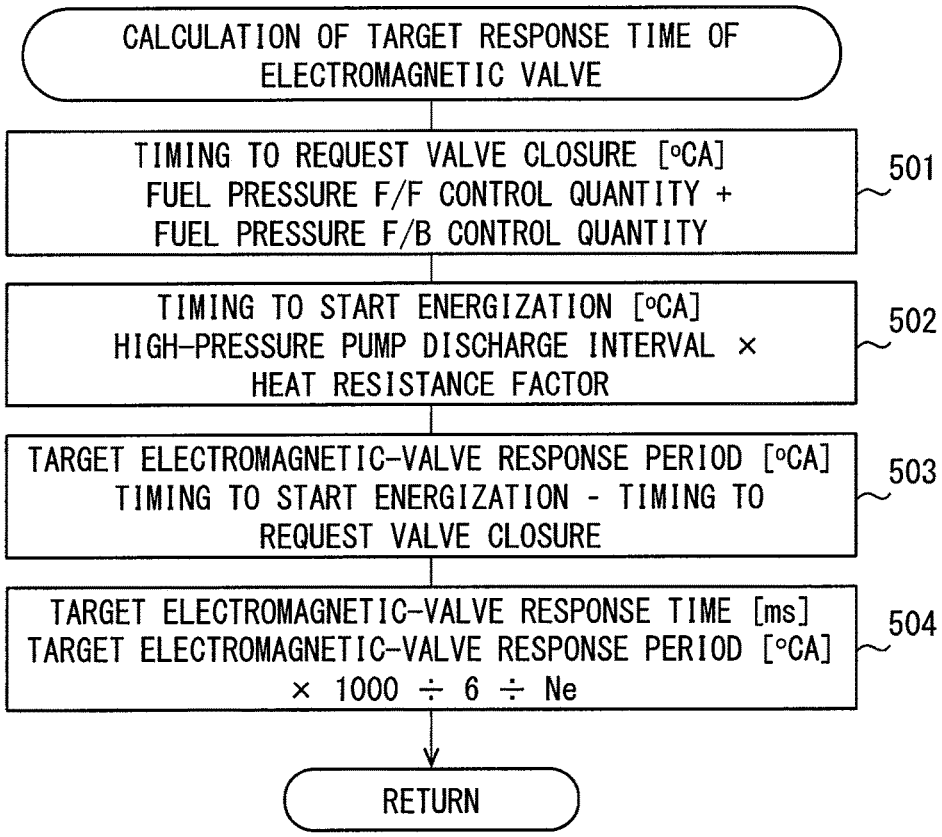
FIG. 15 is a flowchart illustrating a processing flow of a target electromagnetic-valve response time calculation routine according to a second embodiment.

A target electromagnetic-valve response time calculation routine described in FIG. 15 is executed by the ECU 40 repeatedly with a predefined period, when a predefined condition to execute the noise reduction control is satisfied. This routine serves as a target setting unit.

When this routine is started, a timing to request valve closure [° CA] is calculated in step 501 using the fuel pressure F/F control quantity and the fuel pressure F/B control quantity on the basis of the following equation.

Figure 17:
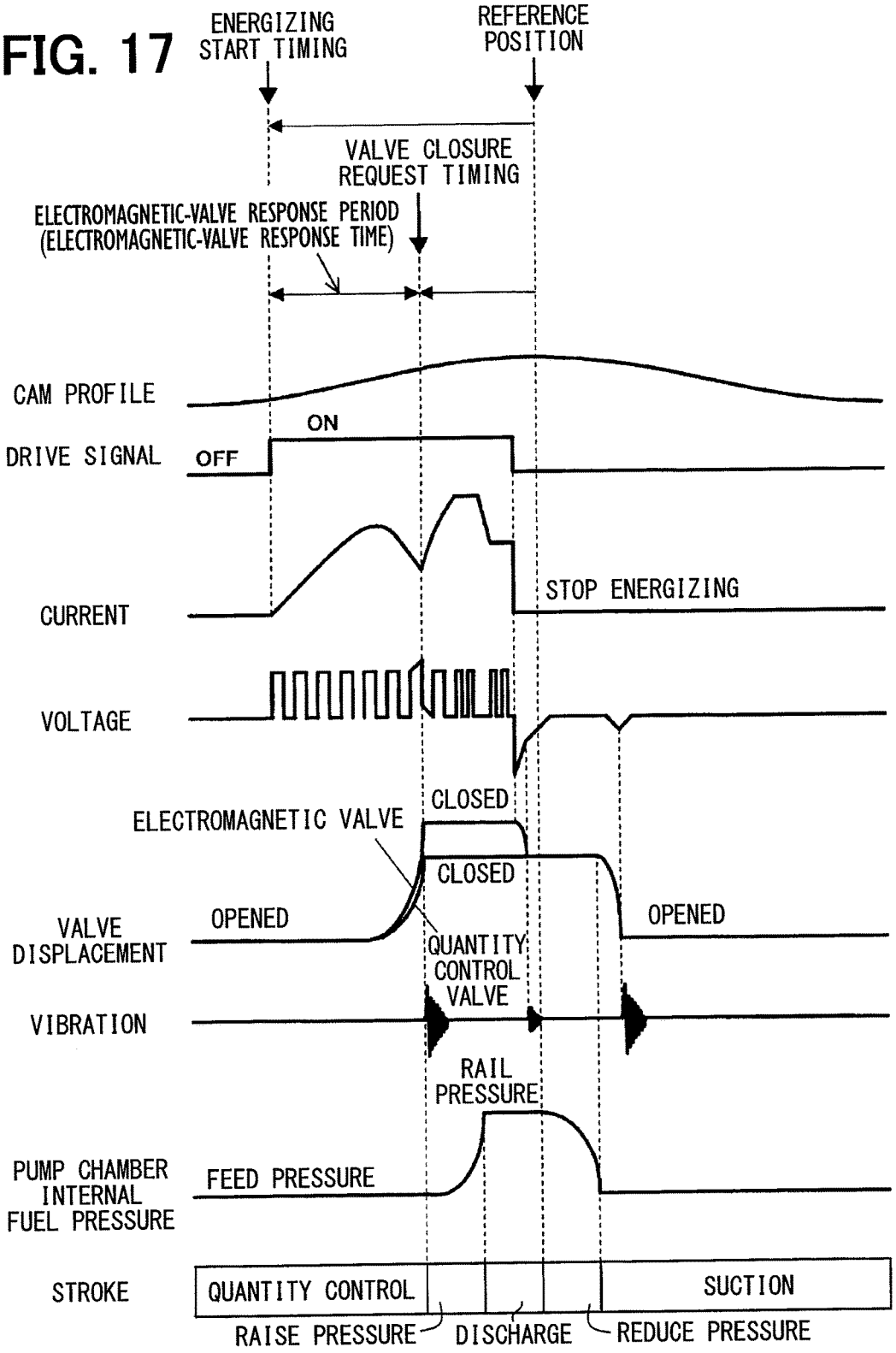
FIG. 17 is a diagram for describing a timing to request valve closure, a timing to start energization, and an electromagnetic-valve response period (electromagnetic-valve response time).

Timing to request valve closure=Fuel pressure *F/F* control quantity+Fuel pressure *F/B* control quantity The timing to request valve closure is set in the form of an advancement quantity from a reference position (for example, a position that corresponds to the top dead center of the plunger 18) (see FIG. 17).

Then, the routine proceeds to step 502, where the timing to start energization [° CA] is calculated using a high-pressure pump discharge interval and a heat resistance factor on the basis of the following equation.

Timing to start energization=High-pressure pump discharge interval×Heat resistance factor The timing to start energization is set in the form of an advancement quantity from a reference position (see FIG. 17). The high-pressure pump discharge interval is, for example, 360° CA for a four-cylinder engine with a two-lobe cam 20. The heat resistance factor is set to a factor (for example, 0.6) that is obtained by giving consideration to the heat resistance of the covering of a solenoid 30 (coil) of the electromagnetic valve 27 to prevent overheating of the electromagnetic valve 27. In this manner, the timing to start energization is set to an upper limit value of the advancement quantity that can prevent overheating of the electromagnetic valve 27 or a value slightly smaller than that.

Then, the routine proceeds to step 503, where a target electromagnetic-valve response period [° CA] is calculated using the timing to start energization and the timing to request valve closure on the basis of the following equation (see FIG. 17).

Target electromagnetic-valve response period=Timing to start energization−Timing to request valve closure Then, the routine proceeds to step 504, where the target electromagnetic-valve response period [° CA] is converted to the target electromagnetic-valve response time [ms] using the current engine rotation speed Ne [rpm] on the basis of the following equation.

Target electromagnetic-valve response time [ms] =Target electromagnetic-valve response period [° CA]×1000÷6÷Ne In this manner, the target electromagnetic-valve response time is set such that the electromagnetic-valve response time is maximized within a range that can prevent overheating of the electromagnetic valve 27 and thereby the noise from the high-pressure pump 14 is reduced.

[Electromagnetic-Valve Response Time Control Routine]

Figure 16:
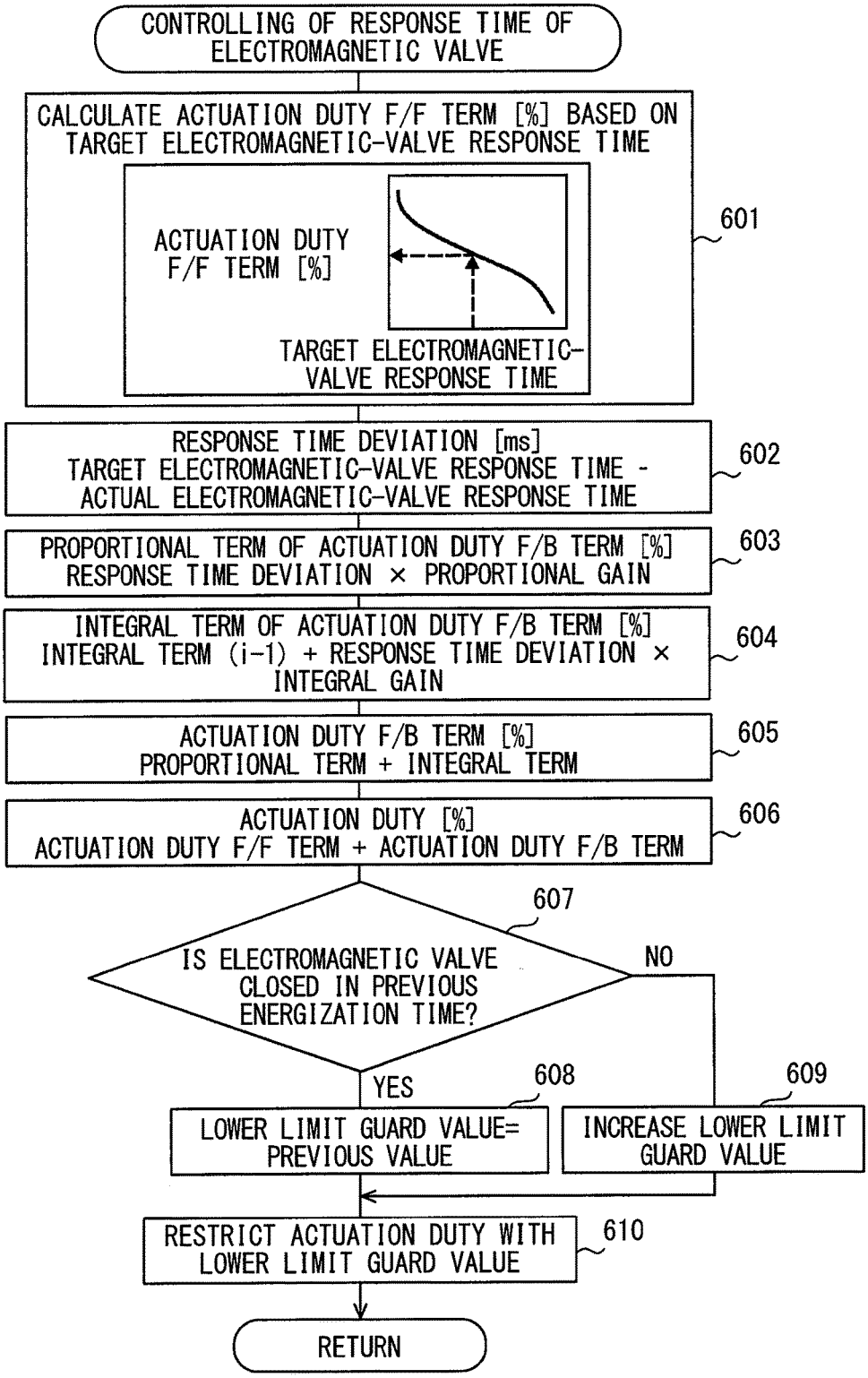
FIG. 16 is a flowchart illustrating a processing flow of an electromagnetic-valve response time control routine.

An electromagnetic-valve response time control routine described in FIG. 16 is executed by the ECU 40 repeatedly with a predefined period, when the predefined condition to execute the noise reduction control is satisfied.

When this routine is started, an actuation duty F/F term [%] for the electromagnetic valve 27 is calculated in step 601 from a map or the like in accordance with the target electromagnetic-valve response time.

Then, an actuation duty F/B term for the electromagnetic valve 27 is calculated in steps 602 to 605 such that the deviation of an actual electromagnetic-valve response time (an electromagnetic-valve response time calculated during previous energization) from the target electromagnetic-valve response time is reduced.

First, in step 602, the deviation of the actual electromagnetic-valve response time from the target electromagnetic-valve response time is calculated as a response time deviation [ms].

Response time deviation=Target electromagnetic-valve response time−Actual electromagnetic-valve response time Then, the routine proceeds to step 603, where the response time deviation is multiplied by a proportional gain to obtain a proportional term [%] of the actuation duty F/B term.

Proportional term=Response time deviation×Proportional gain

Then, the routine proceeds to step 604, where an integral term [%] for this time of the actuation duty F/B term is calculated using the response time deviation, the integral gain, and the previous integral term (i−1) on the basis of the following equation.

Integral term=Integral term ($i$−1)+Response time deviation×Integral gain

Then, the routine proceeds to step 605, where the actuation duty F/B term [%] is calculated using the proportional term and the integral term on the basis of the following equation.

Actuation duty *F/B* term=Proportional term+Integral term

Then, the routine proceeds to step 606, where the actuation duty [%] for the electromagnetic valve 27 is calculated using the actuation duty F/F term and the actuation duty F/B term on the basis of the following equation.

Actuation duty=Actuation duty *F/F* term+Actuation duty *F/B* term

In this manner, the actuation duty for the electromagnetic valve 27 is calculated such that the deviation of an actual electromagnetic-valve response time from the target electromagnetic-valve response time is reduced.

Then, the routine proceeds to step 607, where it is determined whether the electromagnetic valve 27 has been closed during the previous energization. If it is determined in step 607 that the electromagnetic valve 27 has been closed during the previous energization, the routine proceeds to step 608, where a lower limit guard value of the actuation duty is set to a value identical with a previous value.

If it is determined in step 607 described above that the electromagnetic valve 27 has not been closed during the previous energization, the routine proceeds to step 609, where the lower limit guard value of the actuation duty is set to a value obtained by increasing the previous value by a predefined value.

Then, the routine proceeds to step 610, where the actuation duty is restricted to the lower limit guard value. That is, if the actuation duty is greater than the lower limit guard value, the actuation duty is used as it is. If the actuation duty is equal to or less than the lower limit guard value, the actuation duty is set to the lower limit guard value.

After the actuation duty for the electromagnetic valve 27 has been set in the manner described above, the ECU 40 executes processing associated with valve closing control (for example, the processing of step 111 to 118 in FIG. 10) to perform the valve closing control. Specifically, at a point in time when the timing to start the energization of the electromagnetic valve 27 is reached, the electromagnetic valve 27 is energized with the PWM control being performed to periodically switch on and off the voltage to actuate the solenoid 30 of the electromagnetic valve 27 at the actuation duty set in the routine in FIG. 16. In this manner, the supply power to the electromagnetic valve 27 is controlled such that the electromagnetic-valve response time agrees with the target electromagnetic-valve response time. Then, the routine in FIG. 11 described above is executed to calculate the electromagnetic-valve response time. Then, the first constant current control and the second constant current control are performed. Then, the energization of the electromagnetic valve 27 is stopped. In this case, the routine in FIG. 16 and the processing related to the valve closing control serve as an electric power control unit.

Figure 18:
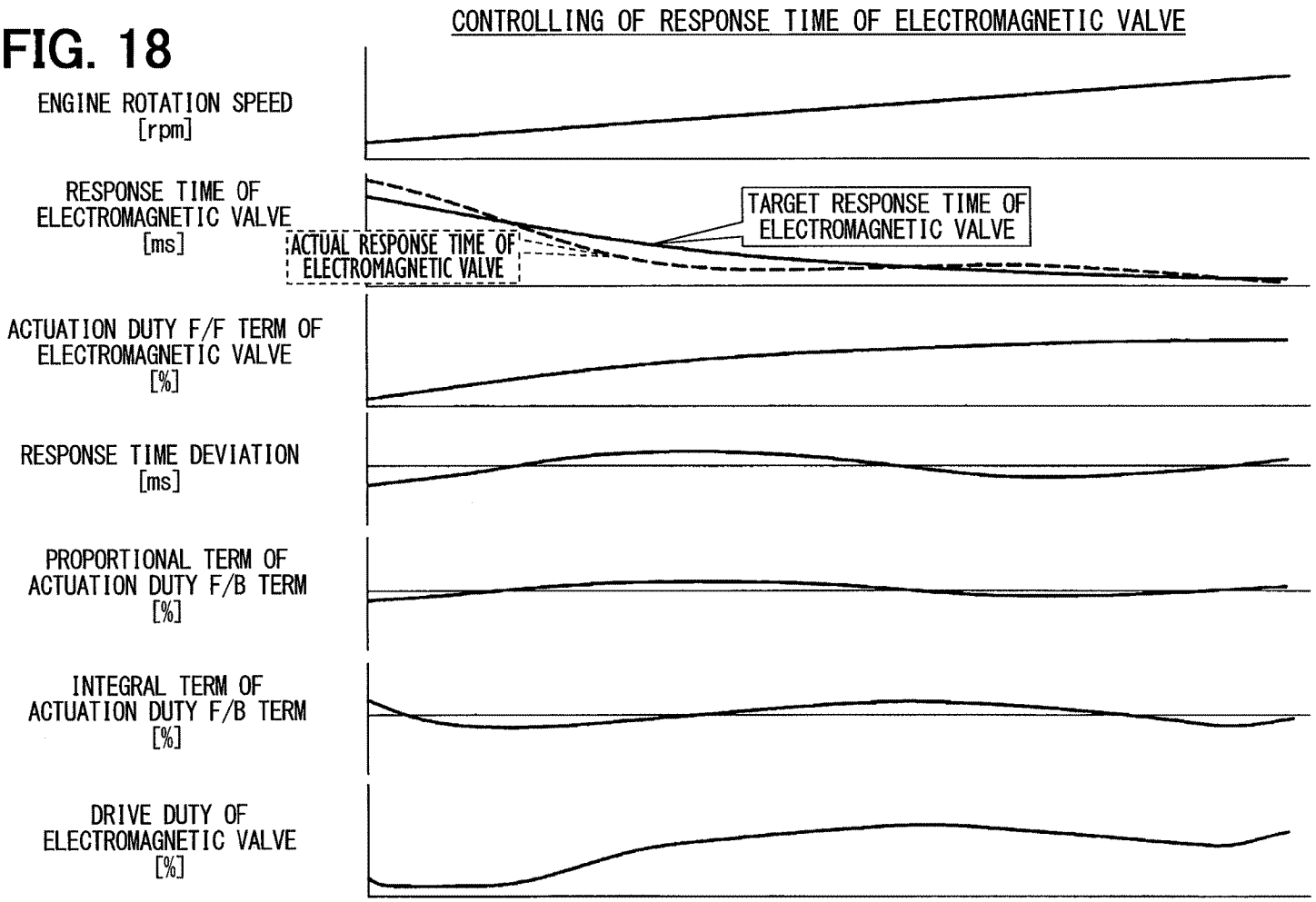
FIG. 18 is a time chart illustrating an execution example of electromagnetic-valve response time control.

As shown in FIG. 18, in the second embodiment described above, during the noise reduction control, the actuation duty for the electromagnetic valve 27 is calculated by calculating the actuation duty FIB term for the electromagnetic valve 27 (=Proportional term+Integral term) such that the deviation of the actual electromagnetic-valve response time from the target electromagnetic-valve response time is reduced. By controlling the supply power to the electromagnetic valve 27 using the actuation duty, the supply power to the electromagnetic valve 27 is controlled such that the actual electromagnetic-valve response time agrees with the target electromagnetic-valve response time. In this manner, the actual electromagnetic-valve response time can be controlled so as to agree with a desired target electromagnetic-valve response time accurately without being affected significantly by individual differences and environmental changes.

In the second embodiment, the target electromagnetic-valve response time is set such that overheating of the electromagnetic valve 27 is prevented. In this manner, overheating of the electromagnetic valve 27 can be prevented and thereby thermal degradation of the electromagnetic valve 27, for example, damage to the covering of the solenoid 30 (coil) and the like can be prevented from occurring.

Moreover, the target electromagnetic-valve response time is set on the basis of the timing to request valve closure, which is set in accordance with the fuel pressure F/B control quantity, and on the basis of the timing to start energization, which is set such that overheating of the electromagnetic valve 27 can be prevented. Here, the target electromagnetic-valve response time is set such that the electromagnetic-valve response time is maximized within a range that prevents overheating of the electromagnetic valve 27 and thereby the noise from the high-pressure pump 14 is reduced. In this manner, the accuracy with which the fuel pressure of the high-pressure pump 14 is controlled can be maintained, overheating of the electromagnetic valve 27 can be prevented, and the noise from the high-pressure pump 14 can be reduced.

Third Embodiment

A third embodiment will now be described with reference to FIG. 19. Components substantially identical with or similar to those in the second embodiment are designated with identical symbols and the description thereof will be omitted or simplified, so that differences from the second embodiment will be mainly described.

In the third embodiment, an ECU 40 executes a target electromagnetic-valve response time calculation routine in FIG. 19, to be described hereinafter, to change the target electromagnetic-valve response time in accordance with the temperature of an electromagnetic valve 27.

Figure 19:
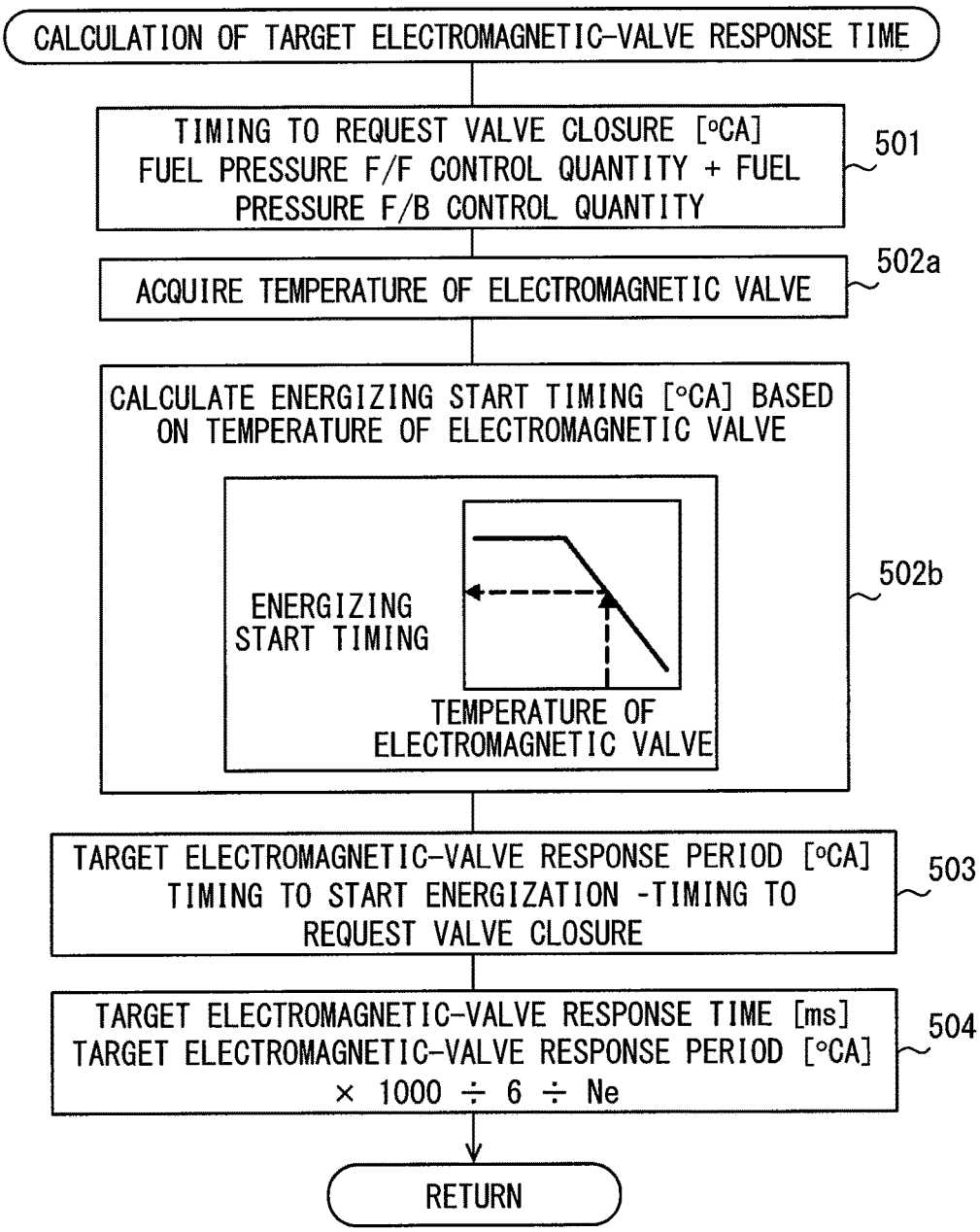
FIG. 19 is a flowchart illustrating a processing flow of a target electromagnetic-valve response time calculation routine according to a third embodiment.

The routine in FIG. 19 to be executed in the third embodiment has identical steps with those of the routine in FIG. 15 described in the second embodiment, except for steps 502*a* and 502*b* that are added in place of step 502.

In the target electromagnetic-valve response time calculation routine in FIG. 19, a timing to request valve closure [° CA] is calculated in step 501 using a fuel pressure F/F control quantity and a fuel pressure F/B control quantity.

Then, the routine proceeds to step 502*a*, where a temperature of the electromagnetic valve 27 is acquired. Here, for example, a temperature sensor may be disposed to sense a temperature of the electromagnetic valve 27 (for example, the temperature of a solenoid 30), so that the temperature of the electromagnetic valve 27 is sensed by this temperature sensor. Alternatively, a temperature of the electromagnetic valve 27 (for example, the temperature of the solenoid 30)

may be estimated on the basis of fuel temperature, cooling water temperature, current through the electromagnetic valve 27, or the like.

Then, the routine proceeds to step 502*b*, where the timing to start energization [° CA] is calculated from a map or the like in accordance with the temperature of the electromagnetic valve 27. To prevent overheating of the electromagnetic valve 27, the map or the like of the timing to start energization is set such that the timing to start energization is retarded (the target electromagnetic-valve response time is reduced) with an increase in temperature of the electromagnetic valve 27 in a region with the temperature of the electromagnetic valve 27 being equal to or greater than a predefined value.

Then, the routine proceeds to step 503, where a target electromagnetic-valve response period [° CA] is calculated using the timing to start energization and the timing to request valve closure. Then, the routine proceeds to step 504, where the target electromagnetic-valve response period [° CA] is converted to the target electromagnetic-valve response time [ms] using the current engine rpm Ne [rpm].

In the third embodiment described above, the target electromagnetic-valve response time is changed in accordance with the temperature of the electromagnetic valve 27. In this manner, the target electromagnetic-valve response time can be set to an appropriate value in accordance with a change in temperature of the electromagnetic valve 27 as the change occurs. For example, when the temperature of the electromagnetic valve 27 is low and thus overheating is unlikely, the target electromagnetic-valve response time can be prolonged to enhance the effect of reducing the noise from the high-pressure pump 14. When the temperature of the electromagnetic valve 27 is high, the target electromagnetic-valve response time can be shortened to prevent the overheating of the electromagnetic valve 27 reliably.

While the target electromagnetic-valve response time is set such that overheating of the electromagnetic valve 27 is prevented in the second and third embodiments described above, this is not limitative. The target electromagnetic-valve response time may be changed as appropriate. For example, the target electromagnetic-valve response time may be set to the upper limit value of the electromagnetic-valve response time described in the first embodiment. In this manner, issues resulting from non-operation of the high-pressure pump 14 can be prevented and the noise from the high-pressure pump 14 can be reduced. Alternatively, the target electromagnetic-valve response time can be set such that the frequency of the electromagnetic valve 27 during the energization is outside the natural frequency range of the high-pressure pump 14 (its resonance frequency range).

Fourth Embodiment

A fourth embodiment will now be described with reference to FIGS. 20 and 21. Components substantially identical with or similar to those in the first embodiment are designated with identical symbols and the description thereof will be omitted or simplified, so that differences from the first embodiment will be mainly described.

Figure 20:
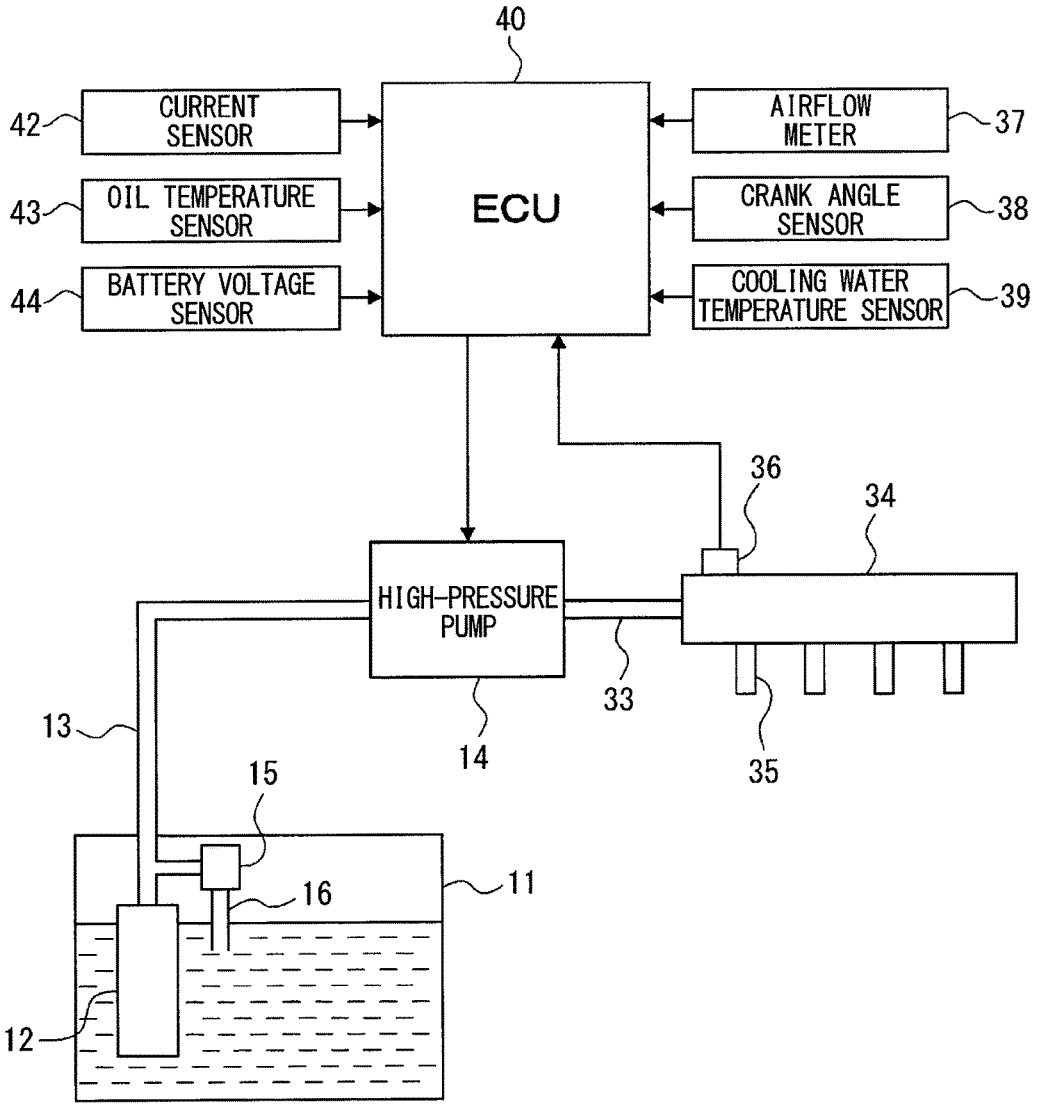
FIG. 20 is a diagram schematically illustrating a configuration of a fuel supply system of a direct injection engine according to a fourth embodiment.

As described in FIG. 20, the fourth embodiment includes an oil temperature sensor 43, which senses the temperature of a lubricant of an engine, and a battery voltage sensor 44, which senses the voltage of a battery that supplies power to an electromagnetic valve 27 of a high-pressure pump 14 (that is, the supply voltage to the electromagnetic valve 27).

Additionally, an ECU 40 executes a routine in FIG. 21, to be described hereinafter, to acquire the temperature of the electromagnetic valve 27 and the battery voltage and to set a valve-closure criterion value on the basis of the temperature of the electromagnetic valve 27 and the battery voltage. The valve-closure criterion value is to be used when it is determined whether the electromagnetic valve 27 has been closed (in other words, it is the valve-closure criterion value used in step 204 of FIG. 11). In this manner, the valve-closure criterion value is changed with a change in characteristic of the electromagnetic valve 27 (for example, a current changing characteristic during energization). The change in characteristic of the electromagnetic valve 27 occurs in accordance with the temperature of the electromagnetic valve 27 and the battery voltage.

The routine in the FIG. 21 to be executed by the ECU 40 in the fourth embodiment will now be described.

[Valve-Closure Criterion Value Setting Routine]

Figure 21:
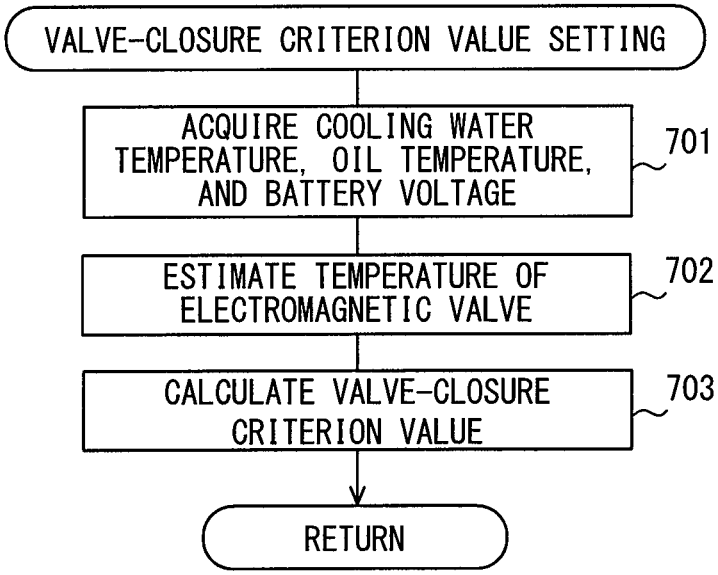
FIG. 21 is a flowchart illustrating a processing flow of a valve-closure criterion value setting routine.

A valve-closure criterion value setting routine described in FIG. 21 is executed by the ECU 40 repeatedly with a predefined period. When this routine is started, a cooling water temperature sensed by a cooling water temperature sensor 39 is acquired in step 701. A lubricant temperature sensed by the lubricant temperature sensor 43 is also acquired. A battery voltage sensed by the battery voltage sensor 44 is also acquired.

Then, the routine proceeds to step 702, where the temperature of the electromagnetic valve 27 is calculated using a map, a mathematical expression, or the like on the basis of the cooling water temperature and the lubricant temperature to estimate the temperature of the electromagnetic valve 27. The processing in steps 701 and 702 serves as an information acquisition unit.

Then, the routine proceeds to step 703, where the valve-closure criterion value is calculated using a map, a mathematical expression, or the like on the basis of the temperature of the electromagnetic valve 27 and the battery voltage. The map, the mathematical expression, or the like of the valve-closure criterion value is set such that, for example, the valve-closure criterion value is reduced with a reduction in current through a solenoid 30 of the electromagnetic valve 27. The current through the solenoid 30 is reduced with an increase in temperature of the electromagnetic valve 27 (that is, an increase in resistance of the solenoid 30) and a reduction in battery voltage. The map, the mathematical expression, or the like of the valve-closure criterion value is prepared in advance on the basis of test data, design data, or the like and stored in a ROM of the ECU 40. The processing in step 703 serves as a criterion-value setting unit.

While the valve-closure criterion value is directly obtained from the temperature of the electromagnetic valve 27 and the battery voltage in this routine, this is not limitative. For example, a correction value may be calculated using a map, a mathematical expression, or the like on the basis of the temperature of the electromagnetic valve 27 and the battery voltage, and the correction value may be used to correct a base valve-closure criterion value to obtain the valve-closure criterion value.

In the fourth embodiment described above, the temperature of the electromagnetic valve 27 and the battery voltage are obtained, and the valve-closure criterion value is set on the basis of the temperature of the electromagnetic valve 27 and the battery voltage. In this manner, the valve-closure criterion value is changed with a change in characteristic of the electromagnetic valve 27 (for example, a current changing characteristic during energization). The change in characteristic of the electromagnetic valve 27 occurs in accordance with the temperature of the electromagnetic valve 27 and the battery voltage. Thus, the valve-closure criterion value can be set to an appropriate value that corresponds to a change in characteristic of the electromagnetic valve 27 as the change occurs. In this manner, the accuracy with which it is determined whether the electromagnetic valve 27 has been closed can be enhanced.

Additionally, in the fourth embodiment, the temperature of the electromagnetic valve 27 is estimated on the basis of the cooling water temperature and the lubricant temperature. In this manner, the need to add a temperature sensor to sense the temperature of the electromagnetic valve 27 is eliminated, and thereby demand for cost reduction can be satisfied.

In the case of a system including a fuel temperature sensor for sensing the temperature of fuel (fuel temperature), the temperature of the electromagnetic valve 27 may be estimated on the basis of the cooling water temperature, the lubricant temperature, and the fuel temperature. Alternatively, the temperature of the electromagnetic valve 27 may be estimated on the basis of one or two of the cooling water temperature, the lubricant temperature, and the fuel temperature. Here, a temperature sensor may be disposed to sense a temperature of the electromagnetic valve 27 (for example, the temperature of the solenoid 30), so that the temperature of the electromagnetic valve 27 is sensed by this temperature sensor.

Additionally, in the fourth embodiment described above, the valve-closure criterion value is set on the basis of both of the temperature of the electromagnetic valve 27 and the battery voltage. This, however, is not limitative. The valve-closure criterion value may be set on the basis of one of the temperature of the electromagnetic valve 27 and the battery voltage.

While the temperature of the electromagnetic valve is used as the information related to the temperature of the electromagnetic valve in the fourth embodiment described above, this is not limitative. In place of the temperature of the electromagnetic valve, at least one of the cooling water temperature, the lubricant temperature, the fuel temperature, and the like may be used.

Moreover, the method of determining whether the electromagnetic valve 27 has been closed is not limited to the method described in the foregoing first embodiment and may be changed as appropriate. Whether the electromagnetic valve 27 has been closed may be determined by comparing the valve-closure criterion value to a parameter that changes in accordance with the behavior of the electromagnetic valve 27 (the solenoid 30), such as the current and voltage to actuate the electromagnetic valve 27.

When the initial value of the supply power to the electromagnetic valve 27 is set to a preset fixed value (for example, a value obtained by providing a wide margin from the lower limit supply power for system variations and the like) every time the engine is started, the following is likely. The time taken to set the supply power to the electromagnetic valve 27 by repeating the processing to reduce the supply power to the electromagnetic valve 27 until the electromagnetic-valve response time reaches a predefined upper limit value (that is, the time taken to reduce the supply power to the electromagnetic valve 27 to the lower limit supply power) may be prolonged every time.

As a solution, the ECU 40 executes routines in FIGS. 22 and 23, to be described hereinafter, to perform control as described below in the fourth embodiment. First, the supply power to the electromagnetic valve 27 set in step 106 of FIG. 9 (that is, the lower limit supply power) is learned while the engine is operated. Then, when the engine is stopped, halt-time information (for example, the temperature of the electromagnetic valve 27 and the battery voltage) is obtained. Then, when the engine is started, start-time information (for example, the temperature of the electromagnetic valve 27 and the battery voltage) is obtained. Additionally, a learned value of the previous supply power to the electromagnetic valve 27 (that is, the lower limit supply power learned during the previous operation of the engine) is corrected on the basis of the halt-time information and the start-time information to set the initial value of the forthcoming supply power to the electromagnetic valve 27.

In this manner, the initial value of the forthcoming supply power to the electromagnetic valve 27 can be set to an appropriately small value (for example, a value slightly greater than the lower limit supply power) with reference to a learned value of the previous supply power to the electromagnetic valve 27 with consideration given to a change in characteristic of the electromagnetic valve 27 due to the change in temperature of the electromagnetic valve 27 (that is, the change in resistance of the solenoid 30) and the change in battery voltage.

The routines in the FIGS. 22 and 23 to be executed by the ECU 40 in the fourth embodiment will now be described.

[Learning and Halt-Time Information Acquisition Routine]

Figure 22:
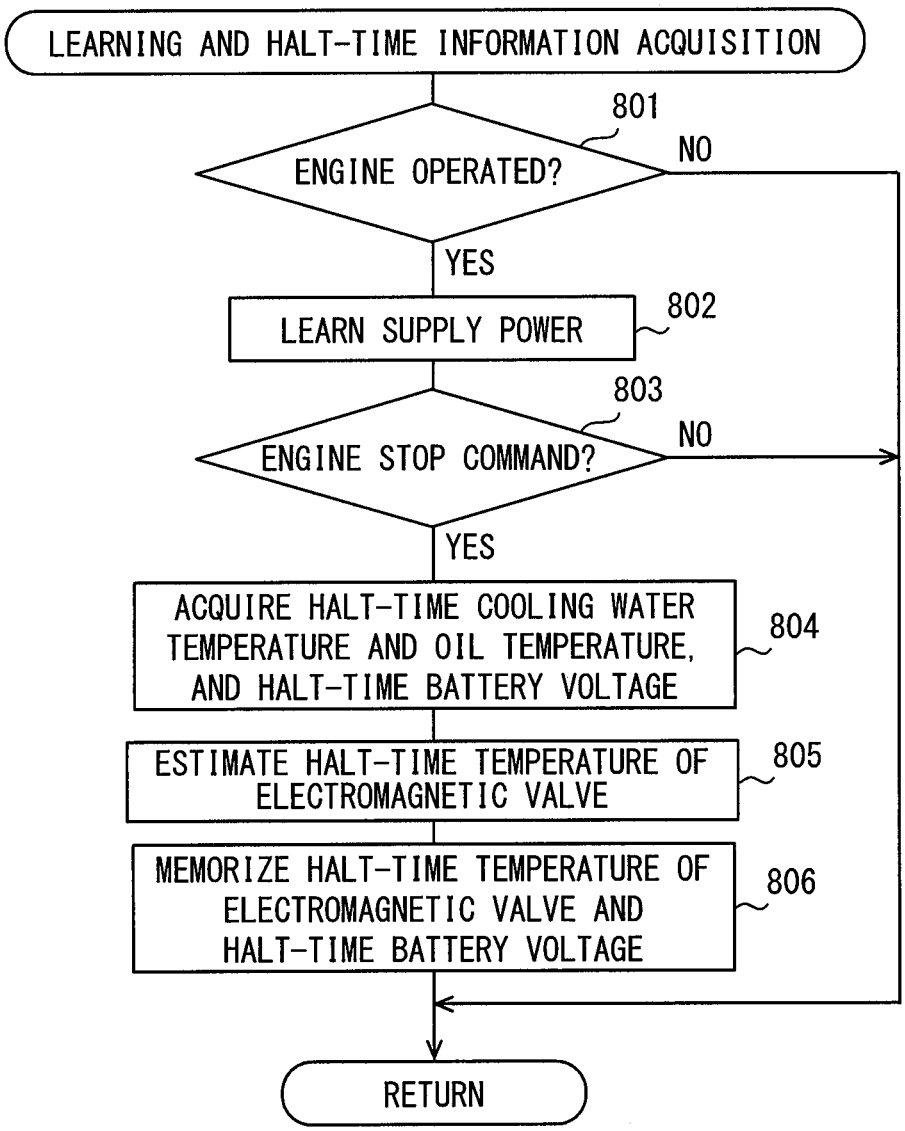
FIG. 22 is a flowchart illustrating a processing flow of a learning and halt-time information acquisition routine.

A learning and halt-time information acquisition routine described in FIG. 22 is executed by the ECU 40 repeatedly with a predefined period. When this routine is started, it is determined in step 801 whether the engine is being operated. If it is determined in step 801 that the engine is not operated (that is, the engine has been stopped), this routine is finished without executing the processing in step 802 and subsequent steps.

If it is determined in step 801 described above that the engine is being operated, the routine proceeds to step 802. The supply power to the electromagnetic valve 27 set in step 106 of FIG. 9 (that is, the lower limit supply power) is learned in step 802. Here, the learned value of the supply power is stored in a rewritable nonvolatile memory, such as a backup RAM of the ECU 40 (that is, a rewritable memory that retains stored data even while the power to the ECU 40 is off). The processing in step 802 serves as a learning unit.

Then, the routine proceeds to step 803, where it is determined whether an engine stop command has been generated. If it is determined in step 803 that the engine stop command has not been generated, this routine is finished without executing the processing in step 804 and subsequent steps.

If it is determined in step 803 described above that the engine stop command has been generated, the routine proceeds to step 804. A cooling water temperature sensed by the cooling water temperature sensor 39 is acquired as a halt-time cooling water temperature in step 804. A lubricant temperature sensed by the lubricant temperature sensor 43 is also acquired as a halt-time lubricant temperature. A battery voltage sensed by the battery voltage sensor 44 is also acquired as a halt-time battery voltage.

Then, the routine proceeds to step 805, where the temperature of the electromagnetic valve 27 at the time of the halt is calculated using a map, a mathematical expression, or the like on the basis of the halt cooling water temperature and the halt lubricant temperature to estimate a halt temperature of the electromagnetic valve 27. The processing in steps 804 and 805 serves as a halt-time information acquisition unit.

While the halt-time information (for example, the temperature of the electromagnetic valve 27 and the battery voltage) is acquired when the engine stop command is generated in this routine, this is not limitative. The halt-time information may be acquired immediately before the engine is stopped (for example, while the engine rpm is decreasing) or immediately after the engine has stopped.

Then, the routine proceeds to step 806, where the halt temperature of the electromagnetic valve 27 and the halt battery voltage are stored in the nonvolatile memory, such as the backup RAM of the ECU 40.

[Start-Time Information Acquisition and Initial Value Setting Routine]

Figure 23:
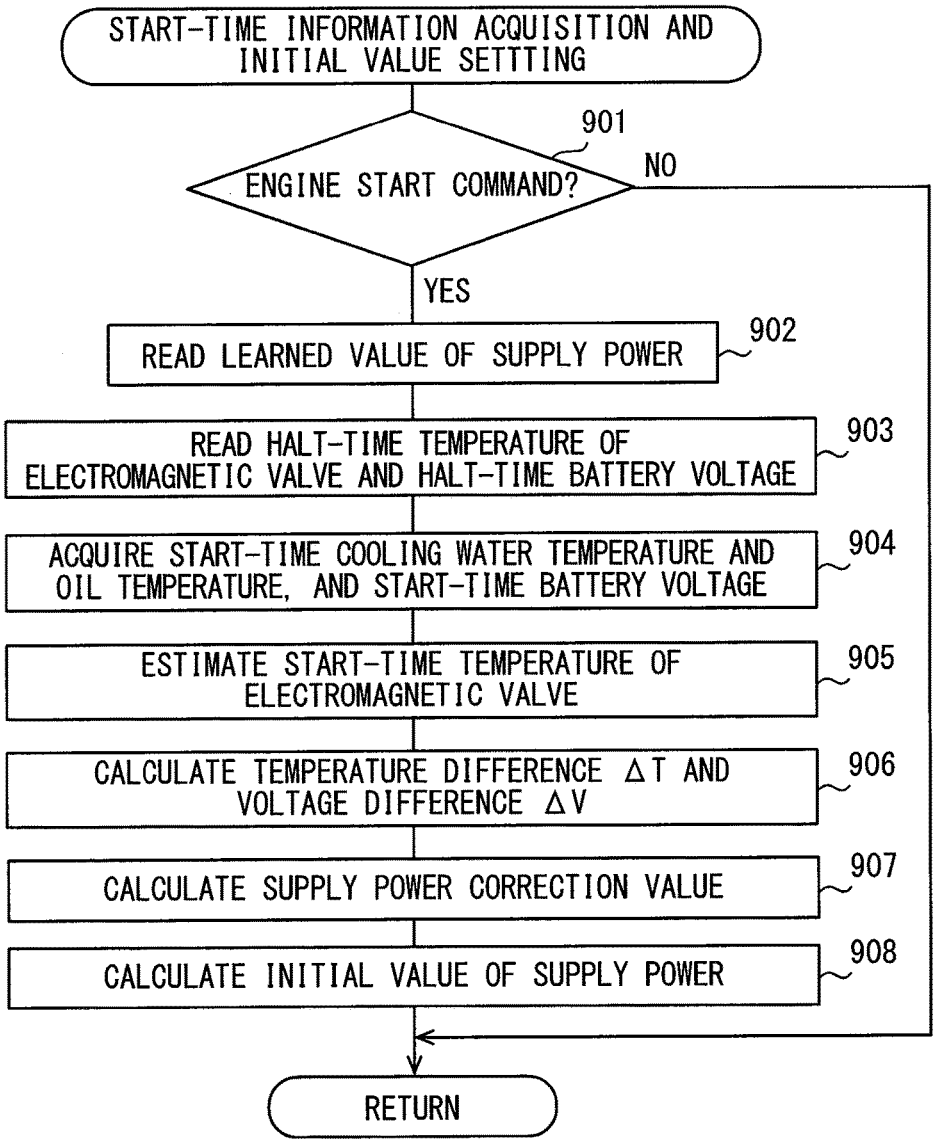
FIG. 23 is a flowchart illustrating a processing flow of a start-time information acquisition and initial value setting routine.

A start-time information acquisition and initial value setting routine described in FIG. 23 is executed by the ECU 40 repeatedly with a predefined period. When this routine is started, it is determined in step 901 whether an engine start command has been generated. If it is determined in step 901 that the engine start command has not been generated, this routine is finished without executing the processing in step 902 and subsequent steps.

If it is determined in step 901 described above that the engine start command has been generated, the routine proceeds to step 902. In step 902, the learned value of the previous supply power to the electromagnetic valve 27 (that is, the lower limit supply power learned during the previous operation of the engine) is read from the nonvolatile memory, such as the backup RAM of the ECU 40.

Then, the routine proceeds to step 903, where the previous halt temperature of the electromagnetic valve 27 and the previous halt battery voltage are read from the nonvolatile memory, such as the backup RAM of the ECU 40.

Then, the routine proceeds to step 904, where a cooling water temperature sensed by the cooling water temperature sensor 39 is acquired as a start cooling water temperature. A lubricant temperature sensed by the lubricant temperature sensor 43 is also acquired as a start lubricant temperature. A battery voltage sensed by the battery voltage sensor 44 is also acquired as a start battery voltage.

Then, the routine proceeds to step 905, where the temperature of the electromagnetic valve 27 at the time of the start is calculated using a map, a mathematical expression, or the like on the basis of the start cooling water temperature and the start lubricant temperature to estimate a start temperature of the electromagnetic valve 27. The processing in steps 904 and 905 serves as a start-time information acquisition unit.

While the start-time information (for example, the temperature of the electromagnetic valve 27 and the battery voltage) is acquired when the engine start command is generated in this routine, this is not limitative. The start-time information may be acquired while the engine is being started (for example, during cranking) or immediately after the engine has started.

Then, the routine proceeds to step 906, where a difference between the previous halt temperature of the electromagnetic valve 27 and the present start temperature of the electromagnetic valve 27 is calculated as a temperature difference $\Delta T$. A difference between the previous halt battery voltage and the present start battery voltage is calculated as a voltage difference $\Delta V$.

Then, the routine proceeds to step 907, where a supply power correction value in accordance with the temperature difference $\Delta T$ and the voltage difference $\Delta V$ is calculated using a map, a mathematical expression, or the like. The map, the mathematical expression, or the like of the supply power correction value is prepared in advance on the basis of test data, design data, or the like and stored in the ROM of the ECU 40.

Then, the routine proceeds to step 908, where the learned value of the previous supply power to the electromagnetic valve 27 is corrected using the supply power correction value to obtain the initial value of the forthcoming supply power to the electromagnetic valve 27. The processing from steps 906 to 908 serves as an initial value setting unit.

In the fourth embodiment described above, the supply power to the electromagnetic valve 27 (that is, the lower limit supply power) is learned while the engine is being operated, and, when the engine is stopped, the halt-time information (for example, the temperature of the electromagnetic valve 27 and the battery voltage) is obtained. Then, when the engine is started, the start-time information (for example, the temperature of the electromagnetic valve 27 and the battery voltage) is acquired. The learned value of the previous supply power to the electromagnetic valve 27 is corrected on the basis of the halt-time information and the start-time information to set the initial value of the forthcoming supply power to the electromagnetic valve 27. In this manner, the initial value of the forthcoming supply power to the electromagnetic valve 27 can be set to an appropriately small value (for example, a value slightly greater than the lower limit supply power) with reference to the learned value of the previous supply power to the electromagnetic valve 27 with consideration given to a change in characteristic of the electromagnetic valve 27 due to the change in temperature of the electromagnetic valve 27 and the change in battery voltage. As a result, the time taken to set the supply power to the electromagnetic valve 27 by repeating the processing to reduce the supply power to the electromagnetic valve 27 until the electromagnetic-valve response time reaches the predefined upper limit value (that is, the time taken to reduce the supply power to the electromagnetic valve 27 to the lower limit supply power) can be shortened.

Additionally, in the fourth embodiment, the temperature of the electromagnetic valve 27 is estimated on the basis of the cooling water temperature and the lubricant temperature. In this manner, the need to add a temperature sensor to sense the temperature of the electromagnetic valve 27 is eliminated, and thereby demand for cost reduction can be satisfied.

In the case of a system including a fuel temperature sensor for sensing the temperature of fuel (fuel temperature), the temperature of the electromagnetic valve 27 may be estimated on the basis of the cooling water temperature, the lubricant temperature, and the fuel temperature. Alternatively, the temperature of the electromagnetic valve 27 may be estimated on the basis of one or two of the cooling water temperature, the lubricant temperature, and the fuel temperature. Here, a temperature sensor may be disposed to sense a temperature of the electromagnetic valve 27 (for example, the temperature of the solenoid 30), so that the temperature of the electromagnetic valve 27 is sensed by this temperature sensor.

Additionally, in the fourth embodiment described above, the learned value of the previous supply power to the electromagnetic valve 27 is corrected on the basis of both of the temperature difference $\Delta T$ and the voltage difference $\Delta V$ to set the initial value of the forthcoming supply power to the electromagnetic valve 27. This, however, is not limitative. The learned value of the previous supply power to the electromagnetic valve 27 may be corrected on the basis of one of the temperature difference $\Delta T$ and the voltage difference $\Delta V$ to set the initial value of the forthcoming supply power to the electromagnetic valve 27.

While the temperature of the electromagnetic valve is used as the information related to the temperature of the electromagnetic valve in the fourth embodiment described above, this is not limitative. In place of the temperature of the electromagnetic valve, at least one of the cooling water temperature, the lubricant temperature, the fuel temperature, and the like may be used.

The functions executed by the ECU 40 may be partially or entirely configured in the form of hardware using one or more ICs or the like in each of the first to fourth embodiments.

Various modifications, for example, changes to the configuration of the high-pressure pump and the configuration of the fuel supply system, may be made as appropriate to each of the embodiments within the scope not departing from the spirit of the present disclosure.

The invention claimed is:

1. A control device for a high-pressure pump including: a pump chamber having a suction port and a discharge port for fuel; a plunger configured to reciprocate in the pump chamber; a quantity control valve configured to open and close the suction port; and an electromagnetic valve configured to move the quantity control valve for opening and closing, the high-pressure pump being configured to energize the electromagnetic valve to move a movable portion of the electromagnetic valve to a closed position to close the quantity control valve, the control device comprising:

a determination unit configured to determine whether the movable portion of the electromagnetic valve has been moved to the closed position to close the electromagnetic valve when the electromagnetic valve is energized;

an acquisition unit configured to acquire, as an electromagnetic-valve response time, a period of time from a start of the energization of the electromagnetic valve until when it is determined that the electromagnetic valve has been closed; and an electric power setting unit configured to set a supply power to the electromagnetic valve by repeating a process in which the supply power to the electromagnetic valve is reduced so as to be smaller than a previous value until the electromagnetic-valve response time reaches a predefined upper limit value.

2. The control device for the high-pressure pump according to claim 1, wherein, in case where the electromagnetic-valve response time is shorter than the upper limit value, the electric power setting unit performs the process in which the supply power to the electromagnetic valve is reduced so as to be smaller than the previous value each time when the number of times determining that the electromagnetic valve has been closed reaches a predefined determination count.

3. The control device for the high-pressure pump according to claim 2, wherein the electric power setting unit increases the determination count as the electromagnetic-valve response time becomes longer, or increases the determination count as the supply power to the electromagnetic valve becomes smaller.

4. The control device for the high-pressure pump according to claim 1, wherein the upper limit value is preset based on a characteristic of the electromagnetic valve to one of the electromagnetic-valve response time with which the supply power to the electromagnetic valve is a minimum supply power that is enough to close the electromagnetic valve and a value smaller than that by a predefined value.

5. The control device for the high-pressure pump according to claim 1, further comprising:

an information acquisition unit configured to acquire at least one of information related to temperature of the electromagnetic valve and a supply voltage to the electromagnetic valve; and a criterion-value setting unit configured to set a valve-closure criterion value on a basis of at least one of the information related to the temperature of the electromagnetic valve and the supply voltage to the electromagnetic valve, the valve-closure criterion value being for use when the determination unit determines whether the electromagnetic valve has been closed.

6. The control device for the high-pressure pump according to claim 5, wherein the information acquisition unit estimates the temperature of the electromagnetic valve on a basis of at least one of cooling water temperature, lubricant temperature, and fuel temperature of an internal combustion engine.

7. The control device for the high-pressure pump according to claim 1, further comprising:

a learning unit configured to learn the supply power to the electromagnetic valve set by the electric power setting unit during operation of an internal combustion engine;

a halt-time information acquisition unit configured to acquire halt-time information that is at least one of information related to temperature of the electromagnetic valve and a supply voltage to the electromagnetic valve when the internal combustion engine is stopped;

a start-time information acquisition unit configured to acquire start-time information that is at least one of the information related to the temperature of the electromagnetic valve and the supply voltage to the electromagnetic valve when the internal combustion engine is started; and an initial value setting unit configured to correct a learned value of the supply power to the electromagnetic valve on a basis of the halt-time information and the start-time information to set an initial value of a forthcoming supply power to the electromagnetic valve when the internal combustion engine is started.

8. The control device for the high-pressure pump according to claim 7, wherein the halt-time information acquisition unit and the start-time information acquisition unit estimate the temperature of the electromagnetic valve on a basis of at least one of cooling water temperature, lubricant temperature, and fuel temperature of the internal combustion engine.

9. A control device for a high-pressure pump including: a pump chamber having a suction port and a discharge port for fuel; a plunger configured to reciprocate in the pump chamber; a quantity control valve configured to open and close the suction port; and an electromagnetic valve configured to move the quantity control valve for opening and closing, the high-pressure pump being configured to energize the electromagnetic valve to move a movable portion of the electromagnetic valve to a closed position to close the quantity control valve, the control device comprising:

a determination unit configured to determine whether the movable portion of the electromagnetic valve has been moved to the closed position to close the electromagnetic valve when the electromagnetic valve is energized;

an acquisition unit configured to acquire, as an electromagnetic-valve response time, a period of time from a start of the energization of the electromagnetic valve until when it is determined that the electromagnetic valve has been closed;

a target setting unit configured to set a target value of the electromagnetic-valve response time as a target electromagnetic-valve response time; and an electric power control unit configured to control a supply power to the electromagnetic valve such that the electromagnetic-valve response time becomes equal to the target electromagnetic-valve response time.

10. The control device for the high-pressure pump according to claim 9, wherein the target setting unit sets the target electromagnetic-valve response time to restrict overheating of the electromagnetic valve.

11. The control device for the high-pressure pump according to claim 10, wherein the target setting unit changes the target electromagnetic-valve response time in accordance with temperature of the electromagnetic valve.

* * * * *